US009751714B2

(12) United States Patent
Saito

(10) Patent No.: US 9,751,714 B2
(45) Date of Patent: Sep. 5, 2017

(54) POST-PROCESSING DEVICE AND IMAGE FORMING SYSTEM PROVIDED WITH THE SAME

(71) Applicant: Takashi Saito, Yamanashi-ken (JP)

(72) Inventor: Takashi Saito, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 0 days.

(21) Appl. No.: 14/694,441

(22) Filed: Apr. 23, 2015

(65) Prior Publication Data

US 2015/0307305 A1 Oct. 29, 2015

(30) Foreign Application Priority Data

Apr. 23, 2014 (JP) ..... 2014-089467
Apr. 23, 2014 (JP) ..... 2014-089468

(51) Int. Cl.

| | |
|---|---|
| ***B65H 5/22*** | (2006.01) |
| ***B65H 43/00*** | (2006.01) |
| ***B65H 29/12*** | (2006.01) |
| ***B65H 31/30*** | (2006.01) |
| ***B65H 31/36*** | (2006.01) |

(Continued)

(52) U.S. Cl.

CPC ..... *B65H 43/00* (2013.01); *B42C 19/02* (2013.01); *B42C 19/08* (2013.01); *B65H 29/125* (2013.01); *B65H 29/14* (2013.01); *B65H 31/3027* (2013.01); *B65H 31/36* (2013.01); *B65H 29/145* (2013.01); *B65H 2301/4212* (2013.01); *B65H 2301/4213* (2013.01); *B65H 2301/4214* (2013.01); *B65H 2301/42194* (2013.01); *B65H 2403/942* (2013.01); *B65H 2404/1441* (2013.01); *B65H 2511/22* (2013.01); *B65H 2511/414* (2013.01); *B65H 2513/10* (2013.01);

(Continued)

(58) Field of Classification Search

CPC ..... B65H 29/125; B65H 29/145; B65H 2301/4213; B65H 31/3027

See application file for complete search history.

(56) References Cited

U.S. PATENT DOCUMENTS 6,517,065 B2 * 2/2003 Miyake ..... B65H 29/51 270/58.09
2004/0178565 A1 * 9/2004 Reeves ..... B65H 29/12 271/225

(Continued)

FOREIGN PATENT DOCUMENTS

JP 5248785 B2 4/2013

*Primary Examiner* — Howard Sanders
(74) *Attorney, Agent, or Firm* — Manabu Kanesaka

(57) ABSTRACT

A sheet fed from an image forming device to a path carry-in port is guided to a first accumulating section along a straight path or guided to a second accumulating section along a branch path branched from the straight path. A buffer path section is formed so as to make the sheet temporarily stay between a first sheet discharge roller pair disposed on the straight path side of the branch path at a position downstream of a branch portion and a second sheet discharge roller pair disposed in the branch path. The sheet staying in the buffer path section is conveyed to the first accumulating section by rotation of the first and second conveying rollers in one direction and to the second accumulating section by rotation of the first and second conveying rollers in an opposite direction to the one direction.

20 Claims, 15 Drawing Sheets

(51) Int. Cl.
*B42C 19/02* (2006.01)
*B42C 19/08* (2006.01)
*B65H 29/14* (2006.01)

(52) U.S. Cl.
CPC ..... *B65H 2801/27* (2013.01); *B65H 2801/48* (2013.01)

(56) References Cited

U.S. PATENT DOCUMENTS

2005/0067748 A1* 3/2005 Fujii ..... B65H 29/51
270/58.08
2009/0261521 A1* 10/2009 Okamoto ..... B65H 37/04
270/37
2014/0061990 A1* 3/2014 Gamo ..... B65H 29/125
270/1.01

* cited by examiner f1 < f2 < f3

POST-PROCESSING DEVICE AND IMAGE FORMING SYSTEM PROVIDED WITH THE SAME

RELATED APPLICATIONS

The present application is based on, and claims priority from, Japanese Applications No. JP2014-089467 filed Apr. 23, 2014 and No. JP2014-089468 filed Apr. 23, 2014, the disclosure of which is hereby incorporated by reference herein in its entirety.

BACKGROUND OF THE INVENTION

Field of the Invention

The present invention relates to a post-processing device that accumulates sheets fed from an image forming device and performs post-processing for the accumulated sheets and to a post-processing mechanism capable of performing the post-processing without delaying an image forming process performed upstream of the post-processing device.

Description of the Related Art

In general, a system of such a type uses an image forming device provided at an upstream side to form an image on sheets and then uses a post-processing device provided at a downstream side to accumulate the image-formed sheets into a set and to perform bookbinding and other post-processing. Such a system is required, in terms of system operating efficiency, to continuously form an image by means of the upstream side image forming device and to perform the post-processing at the downstream side in accordance with a processing speed of the image forming device.

Thus, in order to meet the above requirement, a conveying system is adopted, in which a succeeding sheet that has been subjected to image formation in an upstream side device and fed therefrom during execution of post-processing such as bookbinding performed for preceding sheets accumulated and aligned in the post-processing device is made to temporarily stay in the middle of a conveying path and then fed to the post-processing device after completion of the post-processing operation.

For example, Japanese Patent No. 5,248,785 (Patent Document 1) discloses a post-processing device provided with a straight path that guides a sheet fed from an image forming device to a first processing section and a switchback path that is branched from the straight path and guides the sheet to a second processing section. This publication proposes a path configuration where a succeeding sheet fed from an upstream side while the first processing section performs a processing operation is made to stay in the switchback path for guiding a sheet to the second processing section and a succeeding sheet fed from the upstream side while the second processing section performs a processing operation is made to stay in the straight path.

An image forming device provided upstream of the above post-processing device is configured to form an image on a sheet at a predetermined timing irrespective of the downstream side post-processing operation and discharges the image-formed sheet from a sheet discharge port. The post-processing device receives the discharged sheet and makes the received sheet stay in the switchback path for guiding a sheet to the second processing section when a post-processing mode specifies the first processing section, while makes the received sheet stay in the straight path for guiding a sheet to the first processing section when the post-processing mode specifies the second processing section. Then, after completion of a current job in the first or second processing section, the staying sheet is fed to the first or second processing for subsequent processing.

Patent Document

[Patent Document 1] Japanese Patent Publication No. 5,248,785

As described above, it is known that, in the processing device having the first and second processing sections, a path buffer section in which the succeeding sheet is made to stay while the first processing section performs the processing operation is disposed on a path (switchback path of the above publication) for guiding a sheet to the second processing section, and a path buffer section in which the succeeding sheet is made to stay while the second processing section performs the processing operation is disposed on a path (straight path of the above Patent Document 1) for guiding a sheet to the first processing section.

As described above, conventionally, in the configuration in which the post-processing is selectively performed in the first and second processing sections, when an executing mode designates the first processing section, the sheet is made to temporarily stay in an buffer area on a sheet conveying path for the second processing section; while when the executing mode designates the second processing section, the sheet is made to temporarily stay in an buffer area on a sheet conveying path for the first processing section.

In the configuration in which the buffer areas are disposed on first and second different areas of the sheet conveying path, it is necessary to provide an area space, a sheet conveying mechanism, a processing mechanism (e.g., path open/close guide) for preventing sheet jamming for each area, resulting in increase in device size and cost. Particularly, the increase in device size goes against a demand for space saving.

An object of the present invention is to provide a processing device capable of arranging, while saving a space, a small-sized buffer mechanism for a sheet to temporarily stay before being conveyed to first and second different accumulating positions.

SUMMARY OF THE INVENTION

To solve the above problem, the present invention is featured as follows. A sheet fed from an image forming device to a path carry-in port is guided to a first accumulating section along a straight path or guided to a second accumulating section along a branch path branched from the straight path. A buffer path section is formed so as to make the sheet temporarily stay across a first sheet discharge roller pair disposed in the straight path at a position downstream of a branch portion between the straight and branch paths and a second sheet discharge roller pair disposed in the branch path. The sheet staying in the buffer path section is conveyed to the first accumulating section by rotation of the first and second conveying rollers in one direction and to the second accumulating section by rotation of the first and second conveying rollers in an opposite direction to the one direction.

Specifically, there is provided a post-processing device including: first and second different accumulating sections (35, 49); a conveying path along which a sheet is fed from a carry-in port (31) to the first accumulating section (35); a branch path (34) branched from the conveying path at a branch portion, along which the sheet is fed to the second accumulating section (49); a first conveying roller pair (first conveying roller 46 to be described later) disposed in the conveying path at a position downstream of the branch portion; a second conveying roller pair (second conveying roller 47 to be described later) disposed in the branch path at a position downstream of the branch portion; and a controller (post-processing controller to be described alter) that controls the first and second conveying roller pairs.

A buffer path section (Pb) for a sheet to temporarily stay at a portion between the first and second conveying roller pairs is disposed over the conveying path and branch path. The controller makes a plurality of sheets sequentially fed to the carry-in port temporarily stay in the buffer path section and selectively conveys the plurality of sheets to the first accumulating section by rotating the first and second conveying rollers in one direction and to the second accumulating section by rotating the first and second conveying rollers in an opposite direction to the one direction.

In the present invention, the buffer section Pb for making the sheet to temporarily stay between the straight path and the branch path is provided, and the plurality of sheets staying in the buffer path section are delivered to the first accumulating section by rotation of the first sheet discharge roller disposed in the straight path side of the branch path at a position downstream of the branch portion and the second sheet discharge roller disposed in the branch path in one direction and to the second accumulating section by rotation of the first and second sheet discharge rollers in an opposite direction to the one direction. With this configuration, the following advantages can be obtained.

When the sheet is guided to the first and second processing sections (accumulating sections), the sheet is made to stay in an area between the straight path and the branch path during execution of the post-processing for the preceding sheets and delivered to the first accumulating section by rotation of the sheet discharge rollers in one direction and to the second accumulating section by rotation of the sheet discharge rollers in an opposite direction to the one direction. With this configuration, as compared with a conventional device in which the buffer path is provided for each of the first and second accumulating sections, a device can be made compact.

Further, structures of a conveying mechanism, open/close mechanism for recovery from sheet jamming, and the like provided in the buffer path can be simplified to achieve space-saving, energy-saving, and noise reduction.

Further, in the present invention, the pair of first sheet discharge rollers disposed in the straight path are made to press-contact with or separate from each other. In a case where the sheet staying in the buffer path is conveyed to the processing section simultaneously with feeding of a succeeding sheet from the carry-in port, when all the sheets are conveyed in the same direction, the first sheet discharge roller pair is put in the press-contact state, and when the sheets are conveyed in an opposite direction, the first sheet discharge roller pair is put in the separated state, whereby problems such as sheet jamming and sheet contamination can be prevented.

BRIEF DESCRIPTION OF THE DRAWINGS

FIGS. 7A and 7B are explanatory views each illustrating an operation state where buffer sheets are conveyed to a first post-processing section, in which FIG. 7A illustrates a state where the sheets are made to stand by in the buffer section and FIG. 7B illustrates a state where the buffer sheets are conveyed from the buffer section to first post-processing section;

FIGS. 8A and 8B are explanatory views each illustrating an operation state where the buffer sheets are conveyed to the first post-processing section, in which FIG. 8A illustrates a state where the buffer sheets are positioned to a processing position on a processing tray and FIG. 8B illustrates a state where the buffer sheets are made to abut against a regulating stopper;

FIGS. 9A and 9B are explanatory views each illustrating an operation state where the buffer sheets are conveyed to a second post-processing section, in which FIG. 9A illustrates a state where the sheets are made to stand by in the buffer section and FIG. 9B illustrates a state where the buffer sheets start being conveyed from the buffer section to second post-processing section;

DESCRIPTION OF THE PREFERRED EMBODIMENTS

Figure 1:
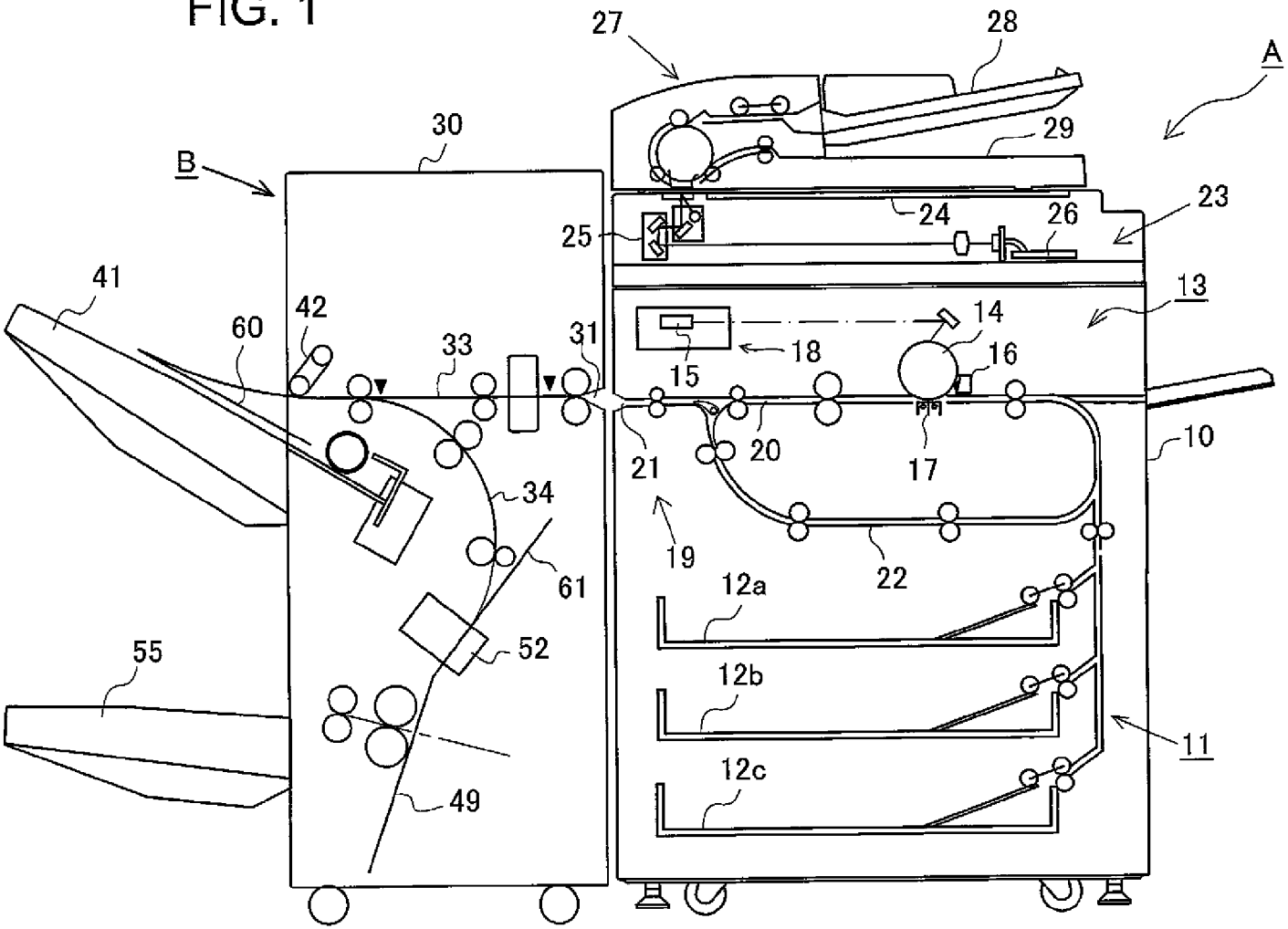
FIG. 1 is an explanatory view of an entire configuration of an image forming system according to the present invention.

Hereinafter, the present invention will be described in detail based on illustrated preferred embodiments. An image forming system illustrated in FIG. 1 includes an image forming device A that forms an image on a sheet and a post-processing device B that performs post-processing (finishing) for the image-formed sheet. In this system, a host device (computer, etc.) that creates image data is connected upstream of the image forming device A over a network. The following describes the image forming device A and post-processing device B in this order.

[Image Forming Device]

The image forming device A is disposed upstream of the post-processing device B and is configured to form an image on a sheet and feeds the image-formed sheet to the downstream side post-processing device B through a sheet discharge port 21. The illustrated image forming device A includes, in a device housing 10, a sheet supply section 11, an image forming section 13, a sheet discharge section 19, and a data processing section 18.

The sheet supply section 11 stores sheets to be image-formed in sheet supply stackers (sheet cassettes) 12*a*, 12*b*, and 12*c* and delivers the sheets of a size specified by an operator one by one to a downstream side image forming section 13.

The image forming section 13 forms an image based on specified image data onto the specified size sheet fed from the sheet supply section 11. As an image forming mechanism of the image forming section 13, various types of image forming mechanisms, such as an electrostatic print mechanism as illustrated, an inkjet print mechanism, a transfer ribbon print mechanism, a thermal print mechanism, and an offset print mechanism can be adopted.

Operation in the image forming section 13 having the illustrated electrostatic print mechanism is as follows. That is, a latent image is formed on a photosensitive drum 14 by means of an optical beam (light emitter) 15, and toner ink is adhered to the latent image by means of a developing unit 16 to thereby form an image on a surface of the drum. The image is then transferred, by means of a charger 17, onto a sheet fed from the sheet supply section 11. In the sheet discharge section 19, the sheet fed from the charger 17 is heated to fix the image thereonto. The resultant sheet is conveyed along a sheet discharge path 20 to the sheet discharge port 21. The sheet discharge port 21 is connected with a duplex path 22, along which the sheet that has once been carried out from the sheet discharge port 21 is fed back (switchback-conveyed) to the image forming section 13 with a conveying direction thereof reversed. During the conveyance along the duplex path 22, front and back surfaces of the sheet are reversed. Then, an image is formed on the back surface of the sheet, and the resultant sheet is carried out through the sheet discharge port 21.

A reference numeral 23 in FIG. 1 denotes a scanner unit. The scanner unit 23 includes a platen 24 on which a document is placed, a reading carriage 25 that scans the document on the platen to read an image on the document, and an image processing section 26 that transfers image data corresponding to the read image to the data processing section 18 of the image forming device A.

A reference numeral 27 in FIG. 1 denotes a feeder unit. The feeder unit 27 feeds sheets set on a sheet supply stacker 28 to the platen 24 one by one while separating them from each other to house the read document sheet in a sheet discharge stacker 29.

[Configuration of Post-Processing Device]

The post-processing device B connected to the above-described image forming device A executes a "first post-processing mode" that accumulates image-formed sheets into a set (group) and performs binding (end binding) or a "second post-processing mode" that accumulates the image-formed sheets in a bundle and then performs folding for the sheet bundle and then houses the resultant (bound or folded) sheet bundle in a downstream side housing section. The illustrated system can further execute a "third post-processing mode (printout mode)" that houses image-formed sheets in a downstream side housing section.

Figure 2:
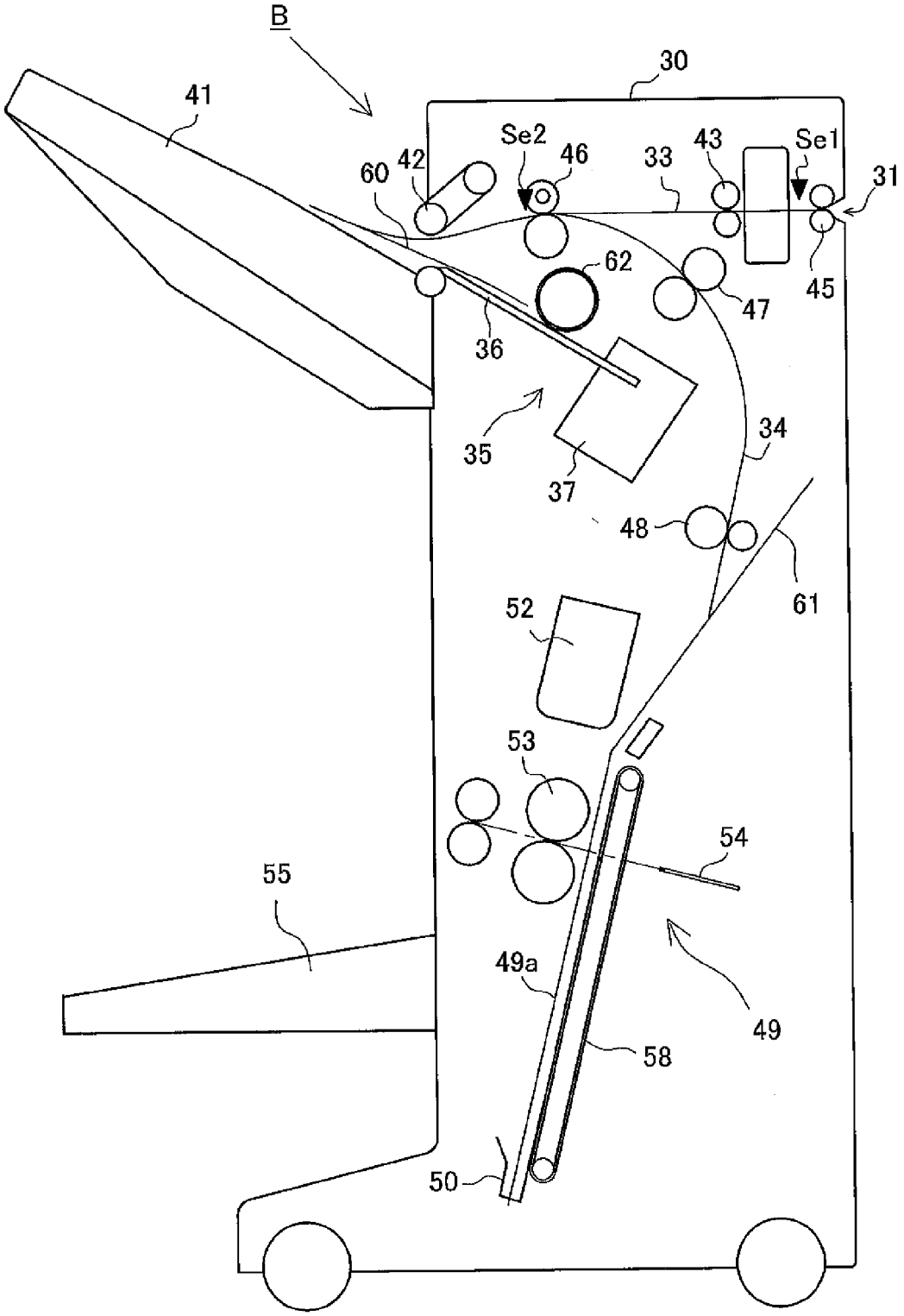
FIG. 2 is an explanatory view of a configuration of a post-processing device in the system illustrated in FIG. 1.

As illustrated in FIG. 2, the post-processing device B includes, in a casing 30, a first post-processing section (first accumulating section) 35 for executing the first post-processing mode and a second post-processing section (second accumulating section) 49 for executing the second post-processing mode. A sheet conveyed along a conveying path 32 having a carry-in port 31 connected to the main body sheet discharge port 21 is distributed to one of the first post-processing section 35 and the second post-processing section 49.

[Configuration of Conveying Path]

The conveying path 32 includes a straight path 33 and a branch path 34. The branch path 34 is branched from the straight path 33 at a path branch portion 32*a* (hereinafter, referred to as "branch portion"), and the sheet carried in from the carry-in port 31 is delivered in one of a straight path direction and a branch path direction. To realize this, a path switching unit 44 is disposed at the branch portion 32*a*. The path switching unit 44 guides a sheet to sheet discharge ports of the respective paths based on a signal from a controller 76 to be described later.

The illustrated straight path 33 is constituted by a substantially straight path. The straight path 33 has the carry-in port 31 at one side surface (right side wall) of the casing 30 and a path sheet discharge port 33*a* at the other side surface (left side wall) of the casing 30. That is, as illustrated in FIG. 2, the straight path 33 is formed so as to horizontally cross the casing 30 in a substantially straight line (or in a curved line), and the first post-processing section 35 is disposed downstream of the path sheet discharge port 33*a* (hereinafter, referred to as "first sheet discharge port").

The branch path 34 extends in a direction crossing the straight path 33. That is, in the casing 30, the straight path 33 extends substantially horizontally in the casing 30, while the branch path 34 extends substantially vertically. As illustrated in FIG. 2, the branch path 34 is branched from the horizontally-extending straight path 33 so as to guide a sheet in the vertical direction toward the second post-processing section 49 from a path sheet discharge port 34*a* (hereinafter, referred to as "second sheet discharge port").

The path switching unit 44 is disposed at the branch portion 32*a*. The path switching unit 44 guides a sheet fed from the carry-in port 31 to the sheet discharge port (first sheet discharge port) 33*a* of the straight path 33 or sheet discharge port (second sheet discharge port) 34*a* of the branch path 34. To realize this, the path switching unit 44 includes a movable guide member (flapper member) and a not illustrated shift unit (operating solenoid, motor, etc.) that shifts an angular position of the movable guide member.

Conveying units for conveying a sheet are disposed in the straight path 33 and branch path 34. In the example illustrated in FIG. 3, a carry-in roller 45 and a sheet discharge roller 46 (first sheet discharge roller) are arranged in a sheet discharge direction in the straight path 33. Specifically, the carry-in roller 45 is disposed at the carry-in port 31, the sheet discharge roller 46 is disposed at the sheet discharge port 33*a*, and a conveying roller (intermediate roller) 43 is disposed between the rollers 45 and 46. On the other hand, in the branch path 34, a sheet discharge roller 47 (second sheet discharge roller) and a third sheet discharge roller are arranged. Specifically, the sheet discharge roller 47 is disposed at the branch path port (branch portion) 32*a*, and the third sheet discharge roller is disposed downstream of the roller 47.

The above-described rollers 45, 46, 47, and 48 (carry-in roller and first, second, third sheet discharge rollers) receive, from a not illustrated drive motor, conveying force for conveying a sheet in the conveying direction. Specifically, the carry-in roller 45 and intermediate roller 43 receive conveying force for conveying a sheet in the sheet discharge direction. The first sheet discharge roller 46 receives conveying force (normal rotation) for carrying out a sheet toward the first sheet discharge port and conveying force (reverse rotation) for conveying a sheet toward the branch path.

The second sheet discharge roller 47 receives conveying force for conveying a sheet in both normal/reverse rotation directions of the drive motor. The third sheet discharge roller 48 receives conveying force for carrying out a sheet from the second sheet discharge port 34*a*. In the illustrated device, the conveying force is transmitted from a single drive motor to the carry-in roller 45 and first to third sheet discharge rollers 46 to 48 through a clutch mechanism.

A switchback path 60 (hereinafter, referred to as "first switchback path") is formed between the first sheet discharge port 33*a* and first post-processing section 35. The first switchback path 60 moves backward a sheet carried out by means of the first sheet discharge roller 46 and whose conveying direction is reversed to a predetermined post-processing position. On the other hand, a switchback path 61 (hereinafter, referred to as "second switchback path") is formed in the branch path 34. The second switchback path 61 guides a sheet whose conveying direction is reversed when a rear end of the sheet passes through the branch portion 32*a* to the second sheet discharge port 34*a*. The switchback paths 60 and 61 are each constituted by a path (straight path 33, branch path 34) for guiding a sheet and normal/reverse rotation control of the conveying roller (first sheet discharge roller 46, second sheet discharge roller 47).

Thus, a sheet carried in from the carry-in port 31 and conveyed along the straight path 33 enters the first post-processing section 35 (processing tray 36 to be described later) in a direction opposite to a direction in which the sheet is carried in, i.e., from the rear end thereof. Further, a sheet conveyed along the branch path 34 enters the second post-processing section 49 (accumulation guide 49*a* to be described later) in the direction opposite to the carry-in direction, i.e., from the rear end thereof. The first switchback path 60 and the second switchback path 61 are disposed spaced apart from each other at respective downstream and upstream sides in the sheet discharge direction of the straight path 33 (see FIG. 2).

Sheet sensors Se1 and Se2 are disposed in the straight path 33. The sheet sensor Se1 detects a sheet passing through the carry-in port 31. The sheet sensor Se2 detects a sheet passing through the first sheet discharge port 33*a*. Detection signals of the respective sensors Se1 and Se2 are used as a reference signal for sheet conveying control, such as control of a guide direction of the path switching unit 44, control of start/stop of the conveying roller, and determination control of sheet jamming.

In the illustrated device, the first sheet discharge roller 46 and the second sheet discharge roller 47 disposed opposite to each other with respect to the branch portion 32*a* are each composed of a pair of rollers that put a sheet therebetween into a pressurization state where the sheet is pressurized at a predetermined pressure when contacting each other and put the sheet into a pressurization release state when separating from each other or while keeping the contacting state. Although a configuration of the roller pair is not illustrated especially, one of the pair of rollers that are brought into press-contact with each other is axially supported so as to be movable in the press-contact direction. The pair of rollers pressurize each other in the press-contact direction by means of a biasing spring, and the pressurizing force is released or reduced by means of a release lever connected to an actuator such as an operating solenoid. The roller pair is thus put into the pressurization state to pressurize each other when the sheet is conveyed by this roller pair or into the pressurization release state to reduce the pressurizing force therebetween when the sheet is conveyed by a different adjacent roller pair so as not to impede the sheet conveyance.

The roller pair is shifted between the pressurization state and pressurization release state by the release lever 67 and an actuator such as an operating solenoid 68. That is, the roller pair is rotated in a press-contact state when a plurality of sheets are conveyed in an overlapped state in a predetermined direction, while the roller pair is separated from the sheet (or press-contact force between the roller pairs is reduced) when the sheet is conveyed by a different adjacent roller pair so as not to impede the sheet conveyance.

[First Post-Processing Section]

The first post-processing section 35 disposed downstream of the first sheet discharge port 33*a* will be described using FIG. 3. A processing tray 36 having a sheet placement surface 36*a* on which a sheet is placed is disposed downstream of the first sheet discharge port 33*a* so as to form a step from the straight path 33. A conveying rotating body 62 (paddle rotating body, belt rotating body, etc.) that conveys a sheet toward a predetermined post-processing position is disposed above the processing tray 36.

The sheet placement surface 36*a* has a sheet end regulating unit 38 that stops a sheet at a predetermined position (post-processing position), an aligning unit 39 that positions a width direction of sheets stacked on the sheet placement surface to a reference position, and a post-processing unit (stapler) 37 that performs binding for sheets.

Figure 3:
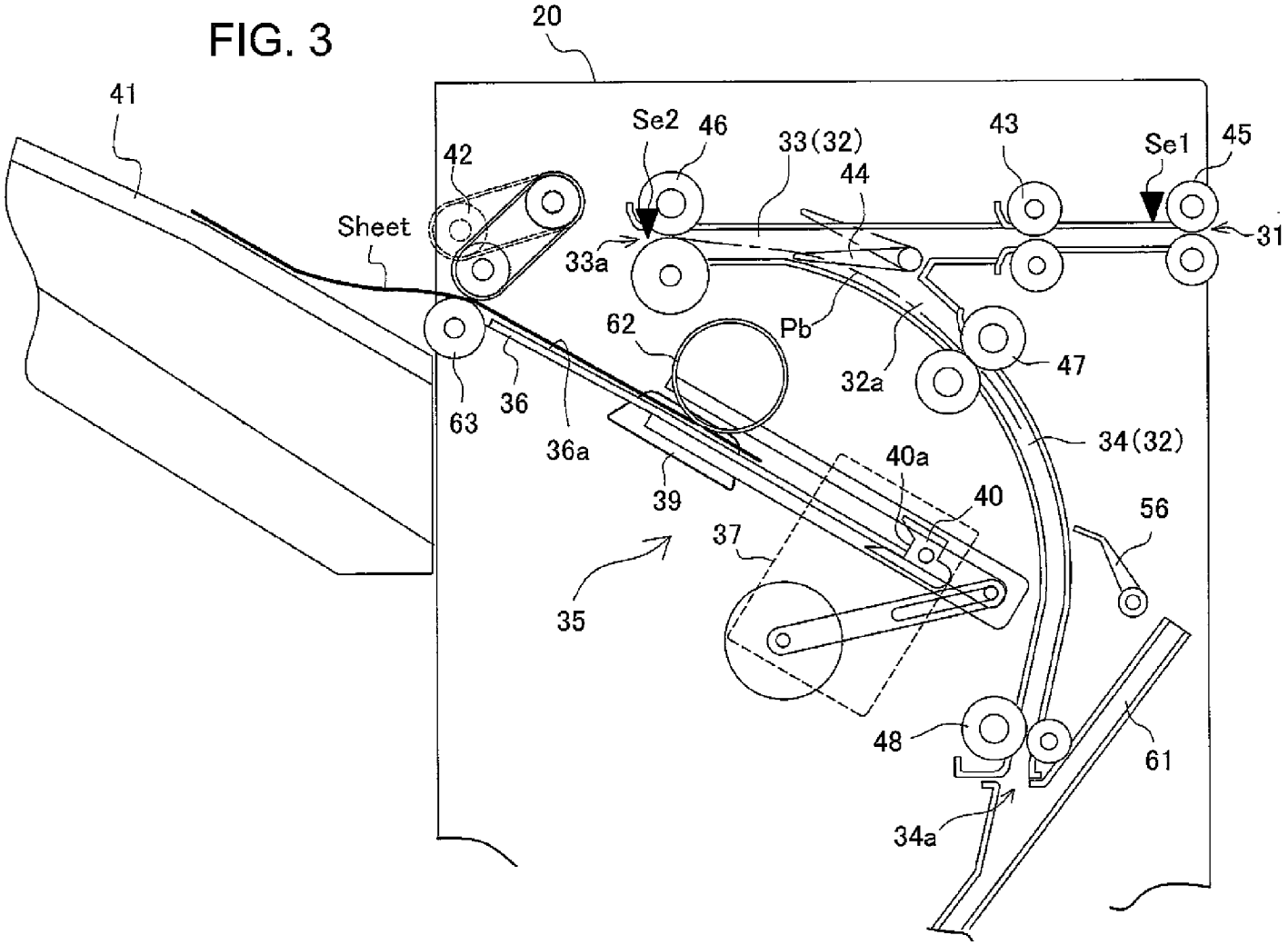
FIG. 3 is an explanatory view of a configuration of a first post-processing section in the post-processing device of FIG. 2.

As illustrated in FIG. 3, the processing tray 36 has a sheet carry-in unit 42 that guides a sheet from the first sheet discharge port 33*a* to the sheet placement surface 36*a* and a sheet carry-out unit 40 that carries out a sheet (bundle) that has been subjected to the post-processing from the sheet placement surface to a first housing stacker 41 on downstream.

The sheet carry-in unit 42 is disposed between the first sheet discharge port 33*a* and the processing tray 36 and configured to reverse the conveying direction of the sheet (to switchback the sheet) carried out from the sheet discharge port and feed the sheet toward the sheet placement surface 36*a*. The sheet carry-in unit 42 is constituted by a lifting roller, a paddle rotating body, a belt rotating body, or the like. In the illustrated example, the sheet carry-in unit 42 is constituted by a lifting roller configured to be vertically movable between an operating position at which it is engaged with a sheet carried out from the first sheet discharge port 33*a* and a standby position retreated from the operating position. The sheet carry-in unit 42, i.e., the lifting roller is connected to a not-illustrated lifting motor and a not-illustrated normally and reversely rotatable motor such that it is rotated in a normal direction until a sheet rear end passes through the first sheet discharge port 33*a* and thereafter rotated in a reverse direction.

The sheet carry-out unit 40 is constituted by a conveyor mechanism that is reciprocated along the sheet placement surface 36*a* between a processing position and the downstream side housing stacker 41. The conveyor mechanism includes an engagement member 40*a* engaged with an end edge of a sheet bundle on the sheet placement surface and a belt (not illustrated) that reciprocally moves the engagement member along the sheet placement surface. Further, the sheet placement surface 36*a* has a roller (fixed roller) 63 opposite to the sheet carry-in unit 42 (lifting roller). Sheets are conveyed in the sheet discharge direction by the roller 63 and lifting roller 42 while being nipped between the rollers 63 and 42.

[Second Post-Processing Section]

Figure 4:
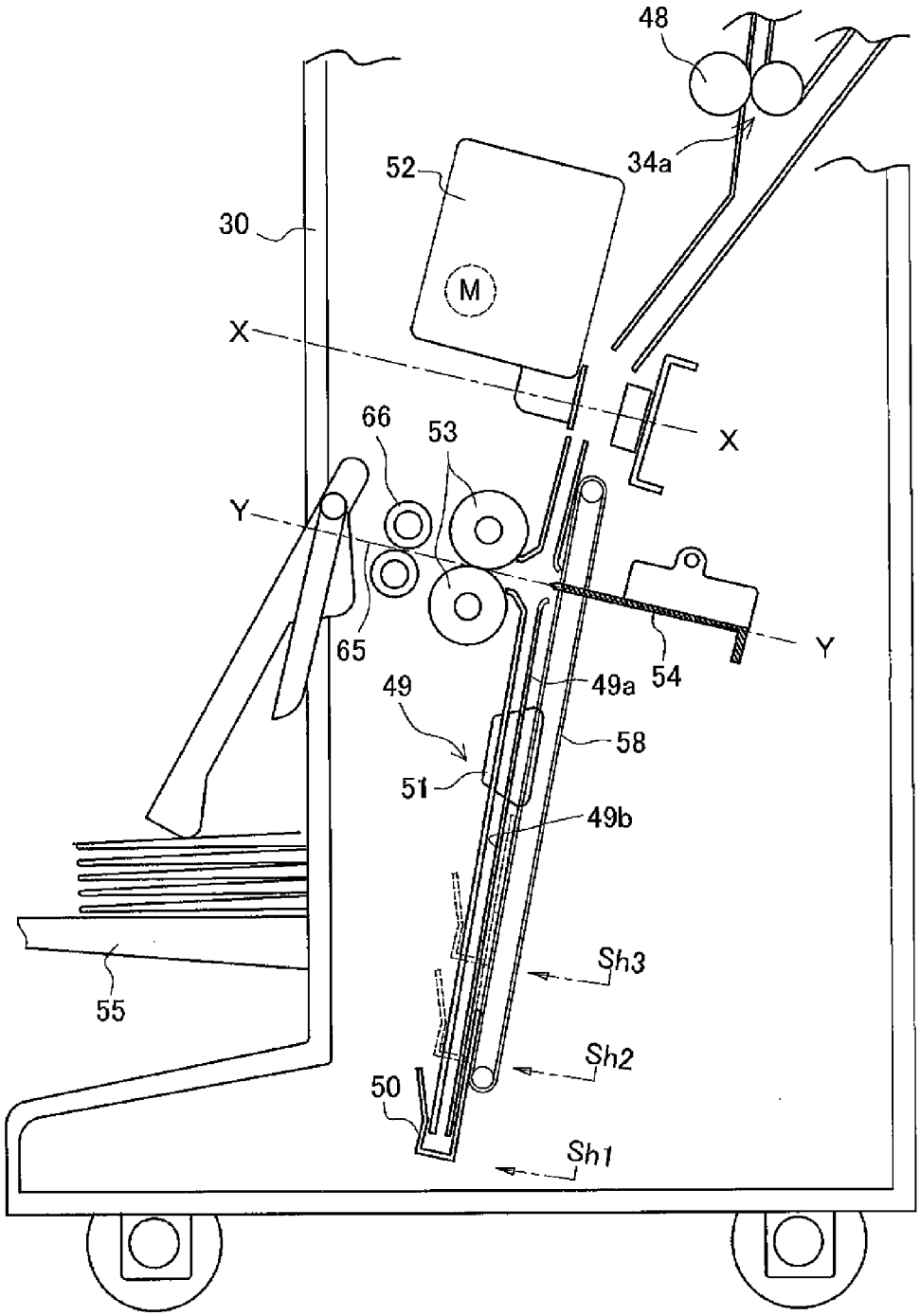
FIG. 4 is an explanatory view of a configuration of a second post-processing section in the post-processing device of FIG. 2.

The second post-processing section 49 disposed downstream of the second sheet discharge port 34*a* will be described using FIG. 4. There are disposed, in the second post-processing section 49, an accumulation guide 49*a* that accumulates and aligns sheets fed from the branch path 34, a binding unit 52 that binds a bundle of the accumulated sheets, and folding units 53 and 54 that center-fold a sheet bundle.

The accumulation guide 49*a* is constituted by a guide member having a stacking surface 49*b* on which sheets fed from the second sheet discharge port 34*a* are stacked in a vertically standing state (standing posture). The accumulation guide 49*a* has a leading end regulating unit 50. The leading end regulating unit 50 is disposed so as to be movable along the accumulation surface and configured to stop an end portion (leading end portion) of a sheet for position regulation. The accumulation guide 49*a* further has an aligning unit 51 that positions a width direction of stacked sheets to a reference position.

The binding unit 52 is constituted by a saddle stitching staple unit that saddle-stitches a sheet bundle on the stacking surface 49*b*. A configuration of this staple unit is widely known, so description thereof will be omitted. The folding unit is constituted by a folding roll 53 and a folding blade 54. The folding roll 53 is constituted by a pair of rolls that are brought into press-contact and is connected to a drive motor (not illustrated) that is rotated in a clockwise direction (folded sheet discharge direction) in FIG. 4.

The folding blade 54 is constituted by a plate-like member that pushes a folding position of a sheet bundle into between the rolls and is connected to a shift motor (not illustrated) so as to be reciprocally moved between a standby position separated from the roll pair and an operating position between the rolls. The aligning unit 51 is constituted by a pair of left and right aligning plates that can move a sheet supported on the stacking surface in the width direction and has a not illustrated aligning motor.

A sheet discharge path 65 and a sheet discharge roller 66 (fourth sheet discharge roller) that carry out a sheet bundle that has been subjected to folding are disposed downstream of the folding roll 53, and a second housing stacker 55 is disposed downstream of the sheet discharge path 65 and the sheet discharge roller 66. The sheet discharge path 65 extends in a direction substantially perpendicular to the stacking surface 49*b* of the second post-processing section 49 and carries out the sheet bundle in the same direction as that in which the straight path 33 carries out the sheet. The second housing stacker 55 is disposed below the first housing stacker 41.

[Buffer Section]

A sheet carried in from the carry-in port 31 and conveyed along the straight path 33 is guided to the first post-processing section 35 through the first sheet discharge port 33*a* or guided to the second post-processing section 49 through the branch path 34. A bundle of sheets accumulated into a set (group) in the first post-processing section 35 is subjected to the binding and then housed in the first housing stacker 41 (first post-processing mode). On the other hand, a bundle of sheets accumulated into a set in the second post-processing section 49 is subjected to the binding and the folding and then housed in the second housing stacker 55 (second post-processing mode).

Thus, sheet conveying control is required, in which a sheet carried in from the carry-in port 31 is made to stay in the middle of the sheet conveying path until completion of post-processing operation of the first post-processing section 35 or the second post-processing section 49. This control is required for the upstream side image forming device A to perform (during execution of post-processing operation) a print process of forming an image on a sheet without interruption.

To this end, a path buffer section Pb (hereinafter, referred to as "buffer section") is provided in the conveying path (straight path 33 and branch path 34), and a sheet fed from the upstream side during execution of the post-processing operation is temporarily stored in the buffer section Pb. One or a plurality of sheets can be made to stay depending on the length of time of the post-processing. As a process speed in the upstream side image forming device A becomes high, the number of sheets to be made to stay in the buffer section Pb of the post-processing device B becomes large.

A configuration of the buffer section Pb in the illustrated device will be described. As illustrated in FIG. 3, the buffer section Pb is disposed astride over the straight path 33 positioned downstream of the branch portion 32*a* and the branch path 34. Specifically, the buffer section Pb is disposed between the first sheet discharge roller 46 (first conveying roller) of the straight path 33 and the second sheet discharge roller 47 (second conveying roller) of the branch path 34, and a sheet is bridged between both the rollers 46 and 47 (bridge support structure). That is, a distance between the first sheet discharge roller 46 and the second sheet discharge roller 47 is set to a value smaller than a conveying direction length of a minimum-sized sheet to be post-processed.

The first and second sheet discharge rollers 46 and 47 are connected to a drive motor (not illustrated) so as to be normally/reversely rotatable. A controller 76 to be described later reverses a rotation direction of the first sheet discharge roller 46 from the normal rotation to reverse rotation to thereby guide a sheet on the straight path 33 to the branch path 34 and then fed to the buffer section Pb. At subsequent sheet supply timing, when the first and second sheet discharge rollers 46 and 47 are rotated in a clockwise direction (normal direction), the sheet staying in the buffer section Pb to the first post-processing section 35; while when the first and second sheet discharge rollers 46 and 47 are rotated in a counterclockwise direction (reverse direction), the sheet staying in the buffer section Pb to the second post-processing section 49.

In the present invention, the first and second conveying rollers for making a sheet temporarily stay are constituted by the "roller pair 46 disposed at the sheet discharge port (first sheet discharge port) of the straight path 33" and "roller pair 47 disposed at an entrance of the branch path 34"; however, positions of the first and second conveying rollers are not limited to these positions, but the first and second conveying rollers may be located at any positions in the respective paths as long as they are front and rear roller pairs disposed at an interval smaller than the conveying direction length of the sheet. Further, although the first and second conveying rollers are each preferably a normally reversely rotatable roller pair, a plurality of roller pairs that can convey the sheet in both sheet discharge direction and counter-sheet discharge direction may be provided as rollers for making a sheet temporarily stay.

The following describes control of the conveying rollers (sheet discharge rollers) when a sheet is made to stay in the buffer section Pb. The conveying roller 45 and first sheet discharge roller 46 (first conveying roller) are rotated in the sheet discharge direction (normal direction; clockwise direction in FIG. 3) to convey a sheet fed to the carry-in port 31 along the straight path 33. Then, upon passage of a rear end of the sheet through the branch portion 32*a*, the first sheet discharge roller 46 is rotated in the counter-sheet discharge direction (reverse direction; counterclockwise direction in FIG. 3). At the same time, the path switching unit 44 is set in a posture (state indicated by a dashed line in FIG. 3) that guides the sheet to the second sheet discharge port side, and the second sheet discharge roller 47 (second conveying roller) is rotated in the counterclockwise direction in FIG. 3, to thereby allows the sheet to enter the branch path 34 from its rear end portion side.

Drive of the path switching unit 44 and conveying rollers (sheet discharge rollers) 46 and 47 is controlled based on detection signals from the respective sheet sensors Set and Se2. A controller 75 to be described later rotates the first sheet discharge roller 46 and the second sheet discharge roller 47 by a rotation amount previously set in accordance with a sheet size and stops the rollers 46 and 47. Then, the sheet conveyed from the carry-in port 31 is fed to the buffer section Pb of the branch path 34 and temporarily stays therein.

[Control Configuration]

Figure 12:
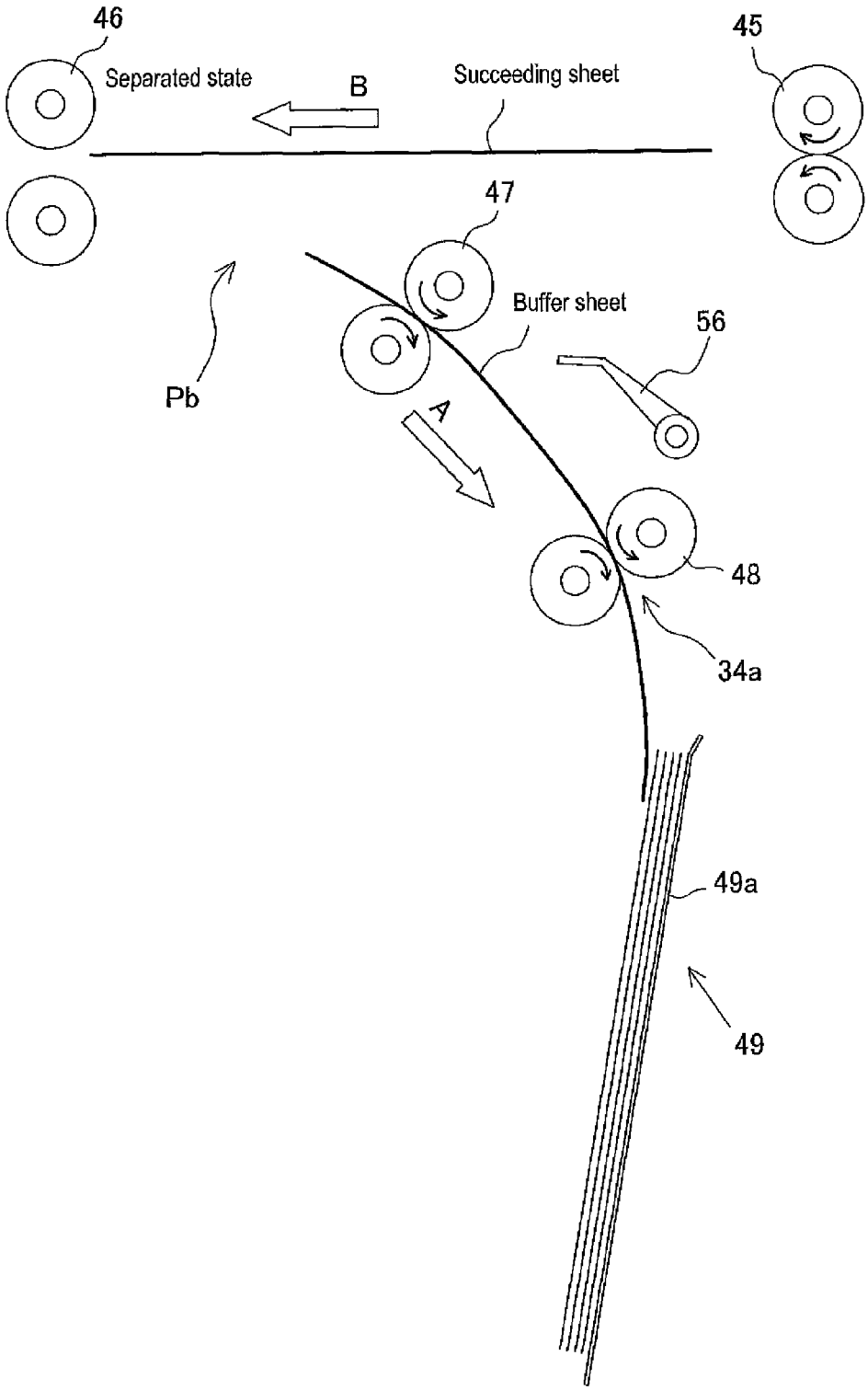
FIG. 12 is an explanatory view illustrating an operation state where the buffer sheets are conveyed to the second post-processing section, in which a last sheet is being carried in the second post-processing section from the buffer section.
Figure 13:
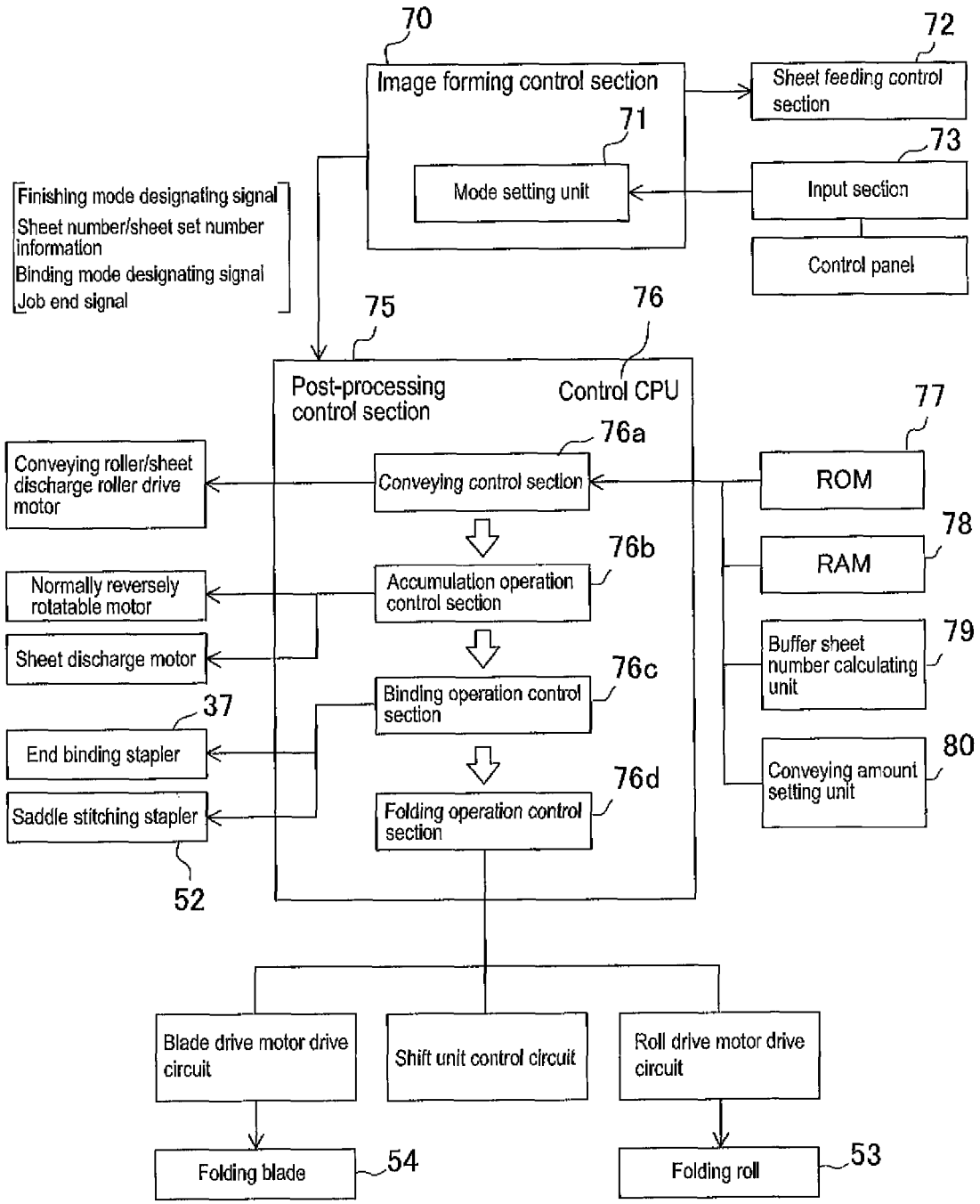
FIG. 13 is an explanatory view of a control configuration in the image forming system of FIG. 1.

The following describes a control configuration in the image forming system of FIG. 1. FIG. 12 is a block diagram of the control configuration. As illustrated in FIG. 12, the control configuration in the image forming system includes an image forming control section 70 and a post-processing control section 75. The image forming control section 70 includes a sheet feeding control section 72 and a mode setting unit 71. The mode setting unit 71 includes an input section 73 such as a control panel. The image forming control section 70 forms an image on a sheet under an image forming condition set in the mode setting unit 71. The sheet feeding control section 72 controls sheet feeding operation of feeding a sheet of a size set in the mode setting unit 71 from the sheet supply section 11 to image forming section 13. The mode setting unit 71 sets image forming conditions such as color/monochrome setting, enlarge/reduction ratio setting, and cover print setting. In addition, the mode setting unit 71 sets a mode of the post-processing performed for an image-formed sheet.

The post-processing device B can execute the first post-processing mode (end binding mode), second post-processing mode (bookbinding mode), and third post-processing mode (printout mode). In the first post-processing mode, image-formed sheets are accumulated and aligned on the processing tray 36 (first post-processing section), subjected to binding, and housed in the first housing stacker 41. In the second post-processing mode, image-formed sheets are accumulated and aligned on the accumulation guide 49*a* (second post-processing section), subjected to saddle stitching and folding, and housed in the second housing stacker 55. In the third post-processing mode, a sheet fed to the carry-in port 31 is not subjected to the post-processing but directly housed in the first housing stacker 41. The "end binding" refers to finishing that binds the accumulated and aligned sheet bundle at one or a plurality of positions along an end surface thereof, "saddle stitching" refers to finishing that binds the accumulated and aligned sheet bundle at a plurality positions around a center portion thereof.

The post-processing control section 75 includes a control CPU 76 that operates the post-processing device B according to a specified post-processing mode (finishing), a ROM 77 that stores an operation program, and a RAM 78 that stores control data. The control CPU 76 includes a conveying control section 76*a* that controls conveyance of a sheet fed to the carry-in port 31, an accumulation operation control section 76*b* that controls sheet accumulation operation, a binding operation control section 76*c* that controls sheet bundle binding operation, and a folding operation control section 76*d* that controls sheet folding operation.

The above control sections 76*a* to 76*d* select and execute the operation mode (first post-processing mode) in which the post-processing is performed in the first post-processing section 35 or operation mode (second post-processing mode) in which the post-processing is performed in the second post-processing section 49.

The conveying control section 76*a* is connected to a control circuit (driver) of a drive motor (not illustrated) driving the carry-in roller 45 (intermediate roller 43) and first sheet discharge roller 46 of the conveying path 32 and receives detection signals from the respective sheet sensors Se1 and Se2 disposed along the conveying path 32. Further, the conveying control section 76*a* is connected to a control circuit (driver) of a drive motor (not illustrated) driving the second and third sheet discharge rollers 47 and 48 and receives a detection signal from a sheet sensor Se3 disposed in the branch path 34.

The conveying control section 76*a* executes control to make a sheet fed to the carry-in port 31 stay in the buffer section Pb during execution of the post-processing operation (e.g., folding operation) in the first post-processing section 35 or the second post-processing section 49. To this end, the conveying control section 76*a* incorporates a buffer sheet number calculating unit 79 that calculates the number of sheets to be made to stay during execution of the post-processing operation and a buffer sheet conveying amount setting unit 80 that conveys a buffer sheet (sheet to be made to stay) at the carry-in port 31 to the buffer section Pb. Details of the buffer sheet number calculating unit 79 and buffer sheet conveying amount setting unit 80 will be described later.

The conveying rollers in each of the straight path 33 and the branch path 34 may be driven by a single drive motor or a plurality of independent drive motors. When the conveying rollers in each of the paths 33 and 34 may be driven by a single drive motor, drive of the motor is transmitted to the conveying rollers through a clutch unit. The accumulation operation control section 76*b* transmits a control signal to drive circuits of the normally reversely rotatable motor for the sheet carry-in unit 42 (lifting roller) and sheet discharge motor for the sheet carry-out unit 40 in order to accumulate sheets in the first accumulating section 35. Further, the binding operation control section 76*c* transmits a control signal to drive circuits of drive motors (not illustrated) incorporated respectively in the end binding stapler 37 of the first post-processing section 35 and the saddle stitching stapler 52 of the second accumulating section 49.

The folding operation control section 76*d* is connected to a drive circuit of a roll drive motor that drives the folding roll pair 53. Further, the folding operation control section 76*d* transmits a control signal to a control circuit of the second and third sheet discharge rollers 47 and 48 of the branch path 34 and a control circuit of the shift unit that controls movement of the leading end regulating unit 50 of the accumulation guide 49*a* to a predetermined position and receives a detection signal from sheet sensors (not illustrated) disposed in the respective conveying paths.

[Buffer Sheet Number Calculating Unit]

The following describes the buffer sheet number calculating unit 79. The calculating unit 79 is incorporated in the conveying control section 76*a*. The calculating unit 79 calculates the number of sheets to be made to stay in the path from a conveying direction length (size information) of a sheet transmitted from the image forming device A and a post-processing time (e.g., sheet alignment time+binding time+folding time+processed sheet carry-out time) previously set and stored as data in the RAM 78. Assuming that the post-processing time is Td, image forming process time is Tp, and buffer sheet number is Bs, [Bs=Td/Tp] . . . (expression 1) is satisfied. Thus, the number of sheets to be made to stay in the buffer section Pb during execution of the post-processing operation in the first post-processing section 35 or the second post-processing section 49 is set.

[Buffer Sheet Conveying Amount Setting Unit]

When the buffer sheets whose number has been calculated by the buffer sheet number calculating unit 79 are conveyed to the buffer section Pb and temporarily stopped (made to stay), the conveying control section 76*a* controls the standby state of the buffer sheets such that the buffer sheets are overlapped while being offset front and rear in the path direction. This is in order to quickly and reliably (without jamming) convey the buffer sheets to the first post-processing section 35 or the second post-processing section 49 after completion of the post-processing operation.

In the illustrated device, a first buffer sheet n is conveyed to the buffer section Pb, and a second buffer sheet is offset (displaced) upstream by a previously set offset amount δ in the conveying direction. To realize this, the conveying control section 76*a* sets (varies), in accordance with the number of the buffer sheets, a conveying amount of the first and second sheet discharge rollers 46 and 47 based on a detection signal of the sheet discharge sensor Set that detects the leading end of the sheet.

For example, assuming that the conveying amount of the first buffer sheet is (Ln), the conveying amount of the second buffer sheet is set to (Ln−δ), and conveying amount of the third buffer sheet is set to (Ln−2×δ), and thereafter similarly, the conveying amount is gradually reduced. The reason that a plurality of sheets are displaced (offset) from each other in the conveying direction will be described later.

[Post-Processing Operation]

The thus configured post-processing control section 75 controls the post-processing device B to execute the following processing operations. As described above, the post-processing control section 75 can make the post-processing device B execute the first post-processing mode (end binding in the first post-processing section 35), second post-processing mode (bookbinding in the second post-processing 49), and third post-processing mode (printed sheet housing processing in the first post-processing section 35). Sheets fed from the image forming device A according to a mode set in the mode setting unit 71 are accumulated in the first post-processing section 35 or the second post-processing section 49, subjected to the post-processing, and housed in the downstream side stacker 41 or 55. The following describes "conveying order of sheets to be conveyed to post-processing section", "conveying operation of buffer sheets", "first post-processing operation", and "second post-processing operation" in this order.

[Conveying Order of Sheets to be Conveyed to Post-Processing Section]

Figure 5:
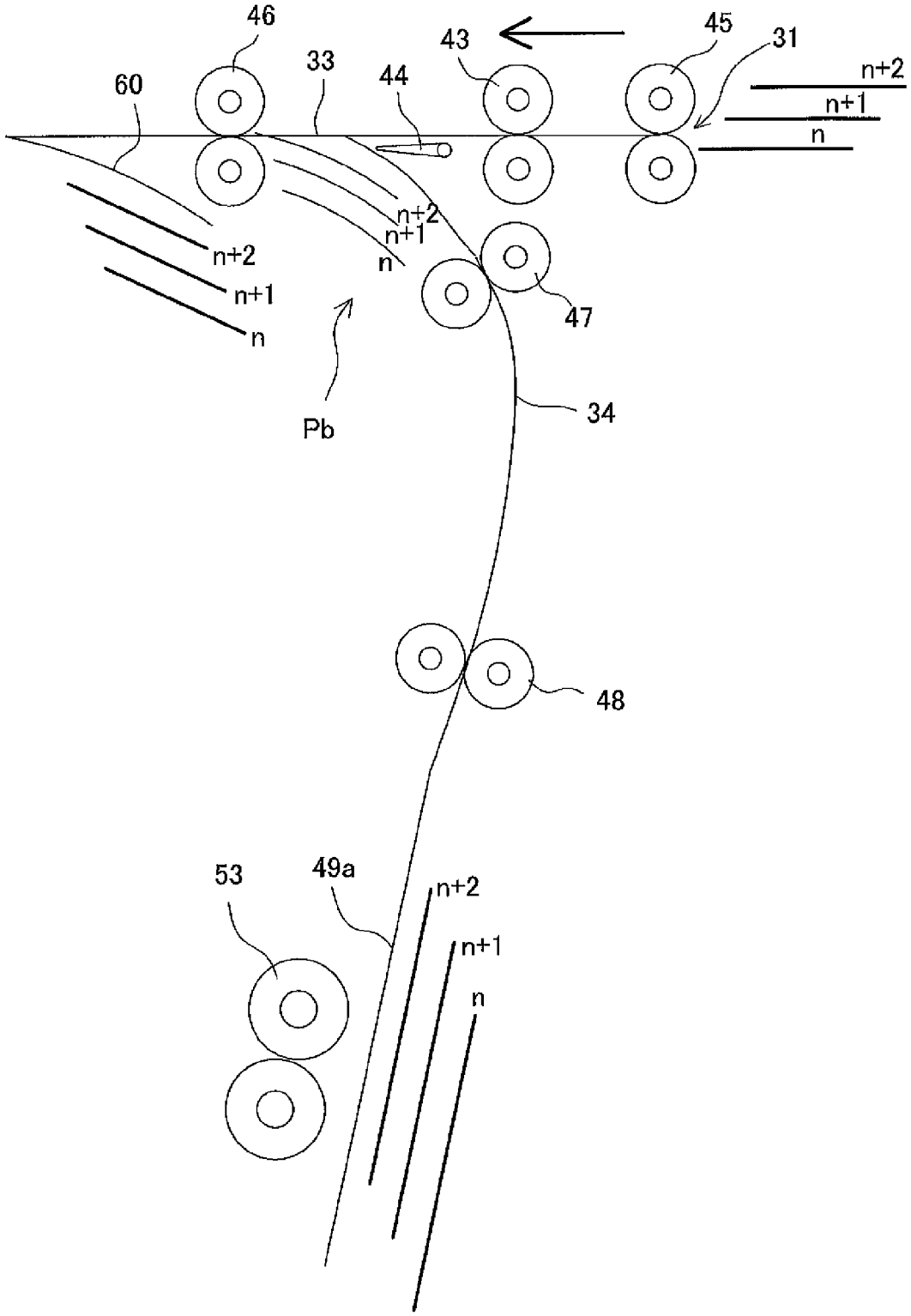
FIG. 5 is an explanatory view of a sheet conveying state in the post-processing device of FIG. 2.

As illustrated in FIG. 5, sheets fed from the carry-in port 31 are conveyed to the first post-processing section 35 along the first switchback path 60 or to the second post-processing section 49 along the second switchback path 61. The sheets are fed to the carry-in port 31 in the image forming order of (n), (n+1), (n+2). The controller (control CPU) 76 conveys the sheets to the first post-processing section 35 through the straight path 33 or to the second post-processing section 49 through the branch path 34. During execution of the post-processing operation in the first post-processing section 35 or the second post-processing section 49, the sheets are made to temporarily stay in the buffer section Pb.

In the first post-processing section 35, the sheets fed from the carry-in port 31 are stacked on the sheet placement surface 36*a* of the processing tray 36 in the order of (n), (n+1), (n+2) from below. Similarly, the sheets to be made to stay in the buffer section Pb are stacked on the path in the order of (n), (n+1), (n+2) from below. Further, similarly, in the second post-processing section 49, the sheets are stacked in the order of (n), (n+1), (n+2) from below. In this state, the sheets in the first post-processing section 35 and those in the buffer section Pb have the same vertical posture, while the vertical posture of the sheets in the second post-processing section 49 differs from that of the sheets in the first post-processing section 35 and the buffer section Pb.

[Conveying Operation of Buffer Sheets to Post-Processing Section]

The plurality of sheets made to stay in the buffer section Pb are collectively fed in a bundle for the first post-processing section 35 while fed one by one in the order that they are fed to the carry-in port 31 for the second post-processing section 49. The details will be described below with reference to FIG. 5. The sheets are fed to the carry-in port 31 in the image forming order of (n), (n+1), (n+2). These sheets are stacked in the buffer section Pb in the same order of (n), (n+1), and (n+2).

Upon completion of the post-processing operation of the post-processing section 35 (or 49), the controller 76 rotates the first and second sheet discharge (conveying) rollers 46 and 47 disposed along the buffer section Pb in the sheet conveying direction. At this time, the controller 76 collectively conveys the buffer sheets stacked in a bundle for the first post-processing section 35; while conveys the buffer sheets stacked in a bundle one by one for the second post-processing section 49.

[First Post-Processing Mode]

Figure 14:
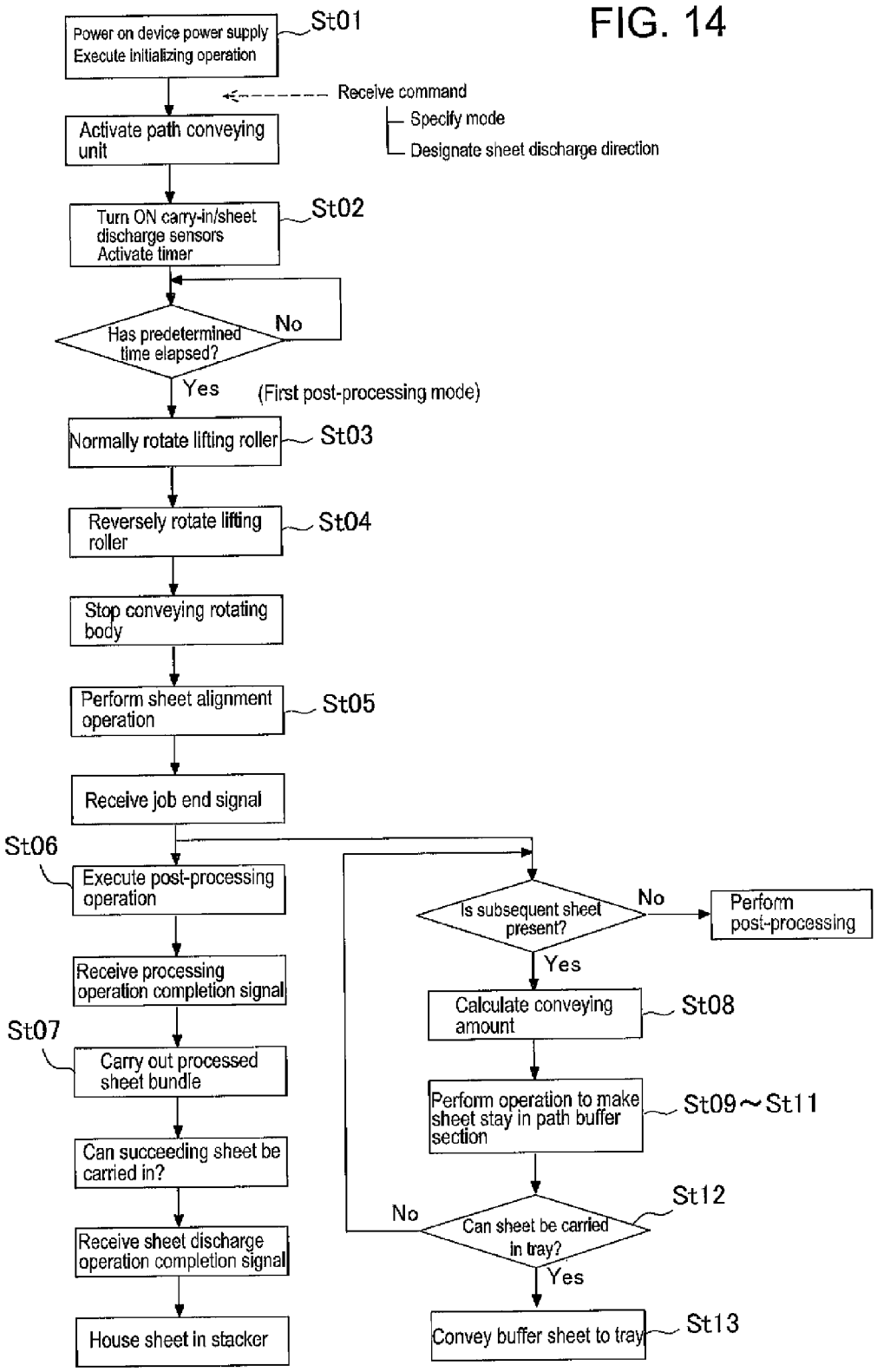
FIG. 14 is a flowchart illustrating a procedure of post-processing operation (first post-processing mode) in the image forming system of FIG. 1.

The following describes an operation procedure of the first post-processing mode (end binding mode) according to a flowchart of FIG. 14. Upon power-on of a device power supply, the controller 76 executes initializing operation (descriptions of which will be omitted) (St01). The path switching unit 44 is positioned so as to allow a sheet to be conveyed in the sheet discharge direction along the straight path 33. The leading and rear ends of the sheet are detected by means of the sensors Se1 and Se2, respectively, and a timer is activated based on a detection signal from the sensor. Which one of the detection signals from the sensors Se1 and Se2 is used to determine (monitor) the sheet conveying state may be appropriately set.

At a timing at which the sheet leading end is carried out from the first sheet discharge port 33*a*, the lifting roller 42 (sheet carry-in unit) is moved down from the standby position to operating position at which it is engaged with the sheet. At the same time, the lifting roller 42 is rotated in the sheet discharge direction to convey the sheet in the sheet discharge direction (St03). At a timing at which the sheet rear end is carried out from the first sheet discharge port 33*a*, the lifting roller 42 is reversely rotated (i.e., rotated in the counter-sheet discharge direction) (St04). Then, the conveying direction of the sheet is reversed (i.e., the sheet is switched back). Accordingly, the sheet is carried into the processing tray 36 disposed downstream of the first sheet discharge port 33*a* from the rear end side thereof and stopped by abutting against the sheet end regulating unit 38 on the tray (St05). Then, the controller 76 positions the width direction of the sheet carried in the first post-processing section 35 to a reference position.

The controller 76 repeats the operation from step St02 to step St05 until it receives a job end signal from the image forming device A. With the above procedure, sheets on which an image has been formed in the image forming device A are accumulated and aligned in the first post-processing section 35. Upon reception of the job end signal from the image forming device A, the controller 76 controls the post-processing unit 37 (stapler) of the first post-processing section 35 to execute the post-processing operation (St06). Subsequently, upon reception of an operation completion signal from the post-processing unit 37, the controller 76 carries out the processed sheet bundle toward the downstream side first housing stacker 41 (St07).

Simultaneously with execution of the above post-processing operation, the controller 76 acquires, from the image forming device A, setting information (in this case, first post-processing mode) of the post-processing mode, a process speed of the image formation, and sheet size information and calls post-processing operation time data in the first post-processing section 35 stored in the RAM 78 of the post-processing device B. Based on the above information, the controller 76 calculates the number of sheets to be made to stay in the path by means of the buffer sheet number calculating unit 79 and calculates a conveying amount of the buffer sheets by means of the buffer sheet conveying amount setting unit 80 (St08).

When a succeeding sheet reaches the carry-in port 31, the controller 76 detects the succeeding sheet by means of the carry-in sensor Se1 and acquires, from a timer's time in the RAM 78, an estimated time for the sheet rear end to reach the branch portion 32*a*. After that, the controller 76 activates a timer in response to the detection signal from the carry-in sensor Se1.

Then, after timer-up, i.e., after elapse of the estimated time for the sheet rear end to pass through the branch portion 32*a*, the controller 76 changes the direction of the path switching unit 44 as indicated by the dashed line in FIG. 3 and, at the same time, rotates the first sheet discharge roller 46 and the second sheet discharge roller 47 in the counter-sheet discharge direction (St09). Then, the sheet enters the branch path 34 from the rear end side, and the controller 76 rotates the first and second sheet discharge rollers 46 and 47 by an amount set by the conveying amount setting unit 80 and then stops the rotation (St10).

Then, when the succeeding (second) sheet (n+1) reaches the carry-in port 31, the controller 76 carries the sheet (n+1) in the buffer section Pb in the same manner as above. A conveying amount of the sheet (n+1) is set to a value smaller than that of the preceding sheet (n) by the offset amount δ. Further, the succeeding (third) sheet (n+2) is carried in the buffer section Pb in the same manner with the conveying amount set to a value smaller than that of the preceding (second) sheet (n+1) by the offset amount δ (St11).

As described above, the sheets fed from the image forming device A during execution of the post-processing operation in the first post-processing section 35 are temporarily retained in a state of being bridged over the branch portion 32*a* between the straight path 33 and the branch path 34 (execution of St11). Then, the controller 76 receives a sheet carry-in permission signal from the first post-processing section 35 (St12). In response to the permission signal, the controller 76 rotates the first and second sheet discharge rollers 46 and 47 in the sheet discharge direction (clockwise direction in FIG. 3). Then, the buffer sheets are conveyed from the buffer section Pb to the first sheet discharge port 33*a* in an overlapped state (St13). The controller 76 rotates the lifting roller 42 and conveying rotating body 62, with the result that the sheet bundle abuts against the sheet end regulating unit 38 of the first post-processing section 35 of the post-processing device B and stopped.

[Second Post-Processing Mode]

Figure 15:
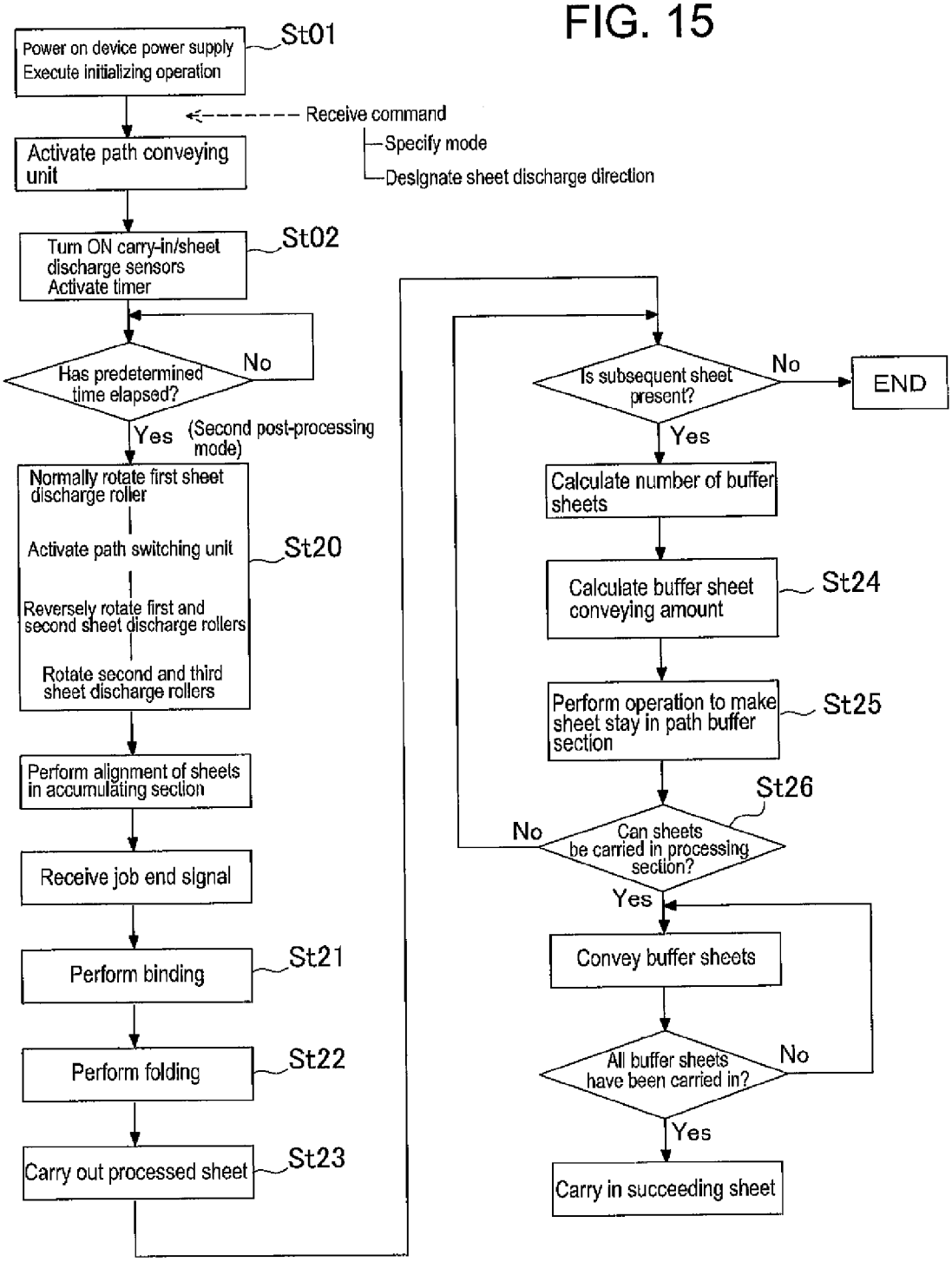
FIG. 15 is a flowchart illustrating a procedure of post-processing operation (second post-processing mode) in the image forming system of FIG. 1.

The second post-processing mode (bookbinding mode) will be described using FIG. 15. Upon power-on of a device power supply, the controller 76 executes initializing operation (St01). When the sheet is fed to the carry-in port 31, the controller 76 detects the leading end thereof and activates a timer (St02). Then, after timer-up, i.e., after elapse of the estimated time for the sheet rear end to pass through the branch portion 32*a*, the controller 76 changes the direction of the path switching unit 44 and rotates the first and second sheet discharge rollers 46 and 47 in the counter-sheet discharge direction to thereby guide the sheet from the straight path 33 to the branch path 34. The sheet is conveyed from the second sheet discharge port 34*a* to the second post-processing section 49 and accumulated on the accumulation guide 49*a* (St20). Upon reception of the job end signal from the image forming device A, the controller 76 moves the sheets accumulated on the accumulation guide 49*a* to a binding position and performs binding by means of the binding unit (St21).

Subsequently, the controller 76 moves the sheet bundle to a folding position, rotates the folding roll pair 53 in a folding direction, and moves the folding blade 54 from the standby position to operating position. Then, the sheet bundle is folded at its center (St22). After execution of the folding operation, the folded sheet bundle is fed to and housed in the second housing stacker 55 (St23).

Simultaneously with execution of the above post-processing operation, the controller 76 calculates the number of sheets to be made to stay by means of the buffer sheet number calculating unit 79 and calculates the conveying amount of the buffer sheets by means of the buffer sheet conveying amount setting unit 80 same as in the first post-processing mode (St24).

When a succeeding sheet reaches the carry-in port 31, the controller 76 conveys the succeeding sheet to the buffer section Pb and makes it stand by therein as in the first post-processing mode (St25). Also in this case, as in the first post-processing mode, the conveying amount is reduced by the offset amount δ and, thereby, a plurality of sheets are made to stay in an overlapped manner in such a manner that they are displaced from each other.

As described above, the sheets fed from the image forming device A during execution of the post-processing operation (binding operation and folding operation) in the second post-processing section 49 are temporarily retained in a state of being bridged over the branch portion 32*a* between the straight path 33 and the branch path 34. Then, the controller 76 receives a sheet carry-in permission signal from the second post-processing section 49 (St26). In response to the permission signal, the controller 76 rotates the third sheet discharge roller 48 in the sheet discharge direction (counterclockwise direction in FIG. 3). Then, the buffer sheet n that has first been made to stay is conveyed from the second sheet discharge port 34*a* to the accumulation guide 49*a*.

At this time, a stopper 56 is positioned so as not to allow the succeeding overlapped buffer sheets (n+1, n+2) to be, drawn downstream (in a direction toward the accumulation guide 49*a*). The controller 76 conveys sequentially the plurality of sheets from the buffer section Pb to the accumulation guide 49*a* in the order that they are made to stay in the buffer section Pb. A sheet conveying speed (peripheral speed of the third sheet discharge roller 48) at this time is set higher than a process speed of the image forming device A. The conveying operation of the buffer sheets to the second post-processing section 49 will be described later.

As described above, the sheets fed from the image forming device A during execution of the post-processing operation in the second post-processing section 49 are conveyed to the buffer section Pb disposed over the branch portion 32*a* between the straight path 33 and the branch path 34 and temporarily retained in a state of being bridged between the first and second sheet discharge rollers 46 and 47 arranged at a predetermined interval (execution of St25). Then, when a state is reached in which the sheets can be carried in the second post-processing section 49, the controller 76 conveys one by one the buffer sheets (n, n+1, n+2) from the second sheet discharge port 34*a* to the accumulation guide 49*a* in the order that they are fed to the carry-in port 31. After all the buffer sheets are carried in on the accumulation guide, a succeeding sheet is stacked on the accumulated buffer sheets.

A sheet fed to the carry-in port 31 during operation of conveying the buffer sheets to the accumulation guide 49*a* is made to stay in the buffer section Pb. This operation flow is repeated until all the sheets are conveyed to the second processing section 49 from the buffer section Pb. To this end, it is necessary to set a speed Vb (in the illustrated example, peripheral speed of the third sheet discharge roller 48) of conveying the buffer sheet to the second post-processing section 49 higher than a speed Va (process speed) of forming an image in the image forming device A (Vb>Va). When the speed difference reaches the conveying amount of the buffer sheet, conveyance of all the buffer sheets to the downstream side accumulating section 49 is completed.

[Operation State of Buffer Sheet Conveyance]

<First Post-Processing Mode>

Figure 7A:
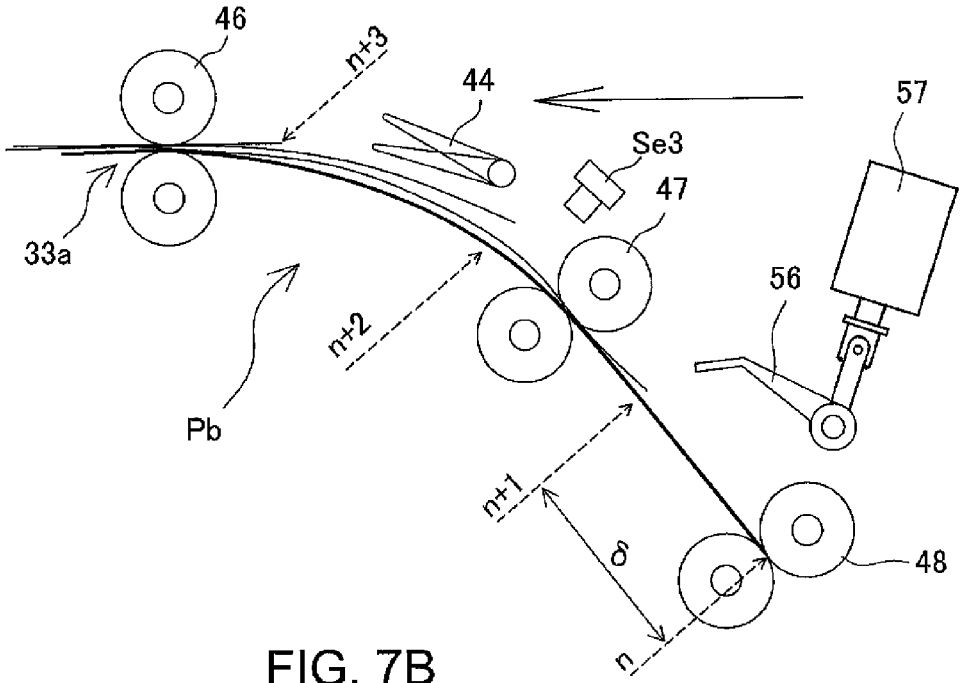
Figure 7B:
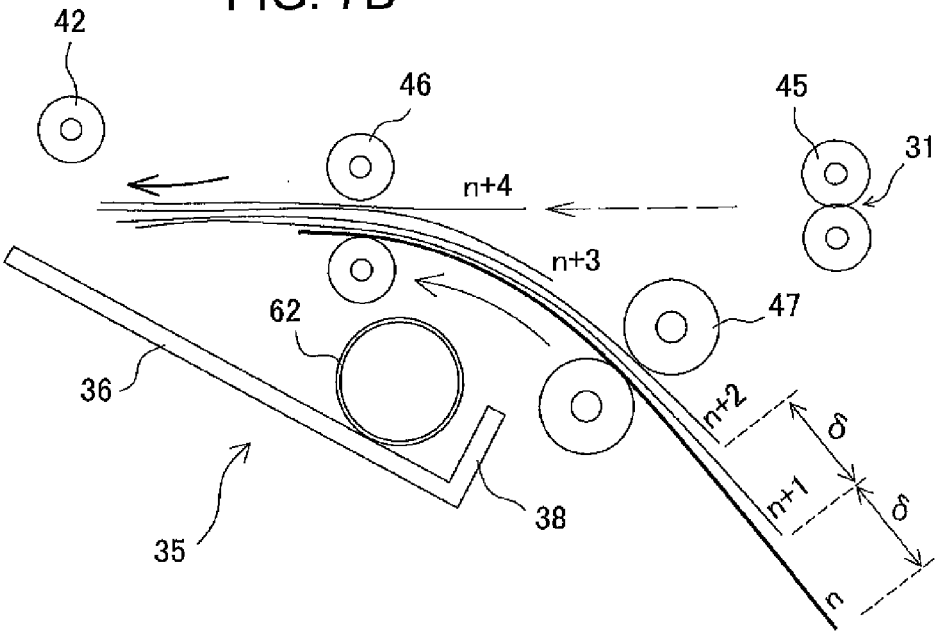

The following describes a buffer sheet conveying state in the first post-processing mode with reference to FIGS. 7A and 7B. FIG. 7A illustrates a state where a plurality of sheets are conveyed to the buffer section Pb and made to temporarily stay. The sheets fed to the buffer section Pb from the carry-in port 31 are retained by the first and second sheet discharge rollers 46 and 47 in a state of being overlapped in the order of the first sheet (n), second sheet (n+1), and third sheet (n+2) from below. More specifically, the plurality of sheets are overlapped in a scale shape with the offset amount δ in the feeding order (in the order that they are fed to the carry-in port 31).

When carrying the buffer sheets in the first post-processing section 35, the controller 76 rotates the first and second sheet discharge rollers 46 and 47 in a stopped state in a direction (clockwise direction in FIG. 7A) guiding the buffer sheets to the first sheet discharge port 33*a* as illustrated in FIG. 7A. Then, the plurality of overlapped sheets are fed from the first sheet discharge port 33*a* to the first accumulating section (processing tray) 35 and made to abut against the sheet end regulating unit 38 illustrated in FIG. 7B by the normal/reverse rotation of the lifting roller 42.

Figure 8A:
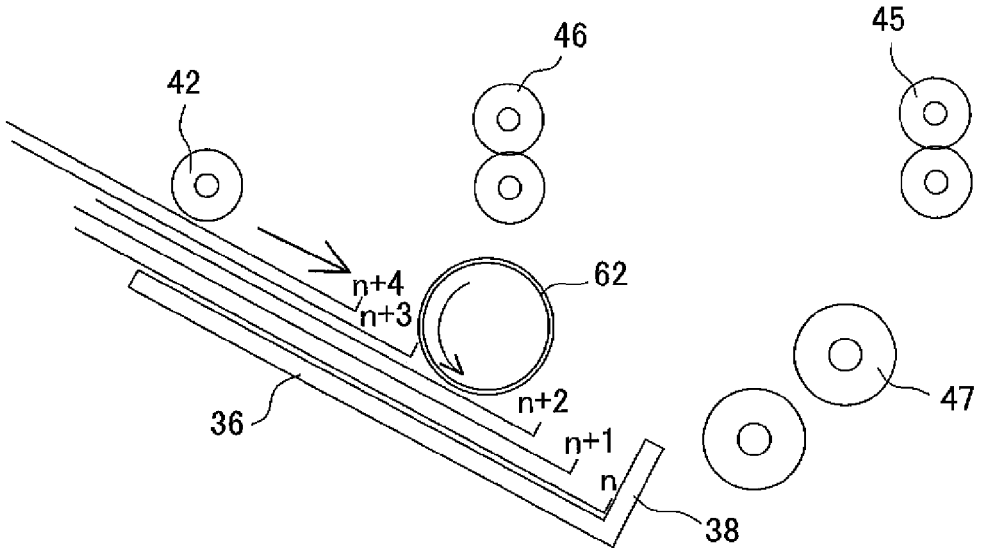
Figure 8B:
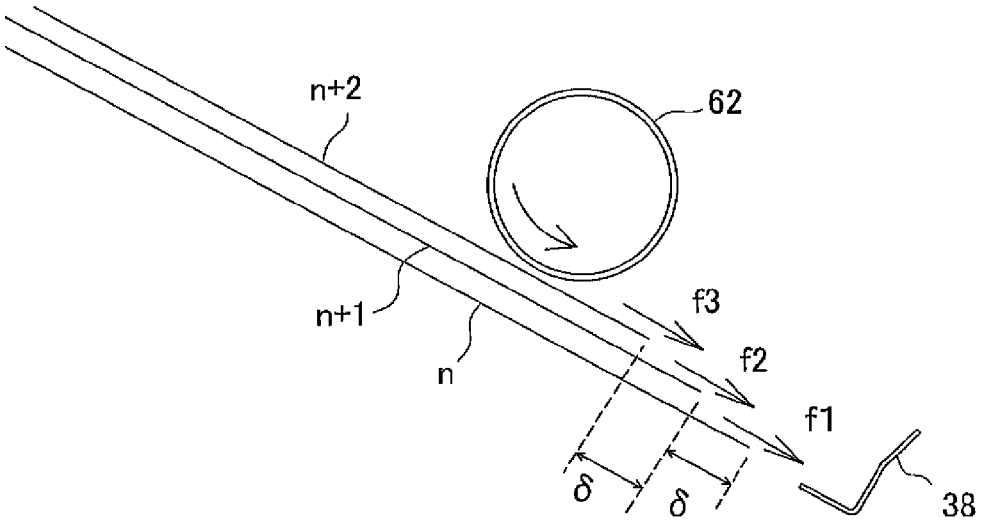

At this time, conveying forces (f1, f2, and f3) are applied from the conveying rotating body 62 to the plurality of sheets, respectively. As illustrated in FIG. 8B, the conveying force f3 acting on the topmost sheet (n+2) engaged with the conveying rotating body 62 is largest, followed by the conveying force f2 acting on the sheet (n+1) under the sheet (n+2) and conveying force f1 acting on the sheet (n) under the sheet (n+1). In this state, the sheets are displaced from each other by the offset amount δ in an approaching/separating direction toward the sheet end regulating unit 38.

Thus, among the sheets displaced from each other by the offset amount δ, the lowermost sheet is closest to the stopper (sheet end regulating unit 38), and the topmost sheet is farthest to the stopper. On the contrary, the conveying forces f are applied to the sheets such that the largest conveying force is applied to the topmost sheet.

<Second Post-Processing Mode>

Figure 9A:
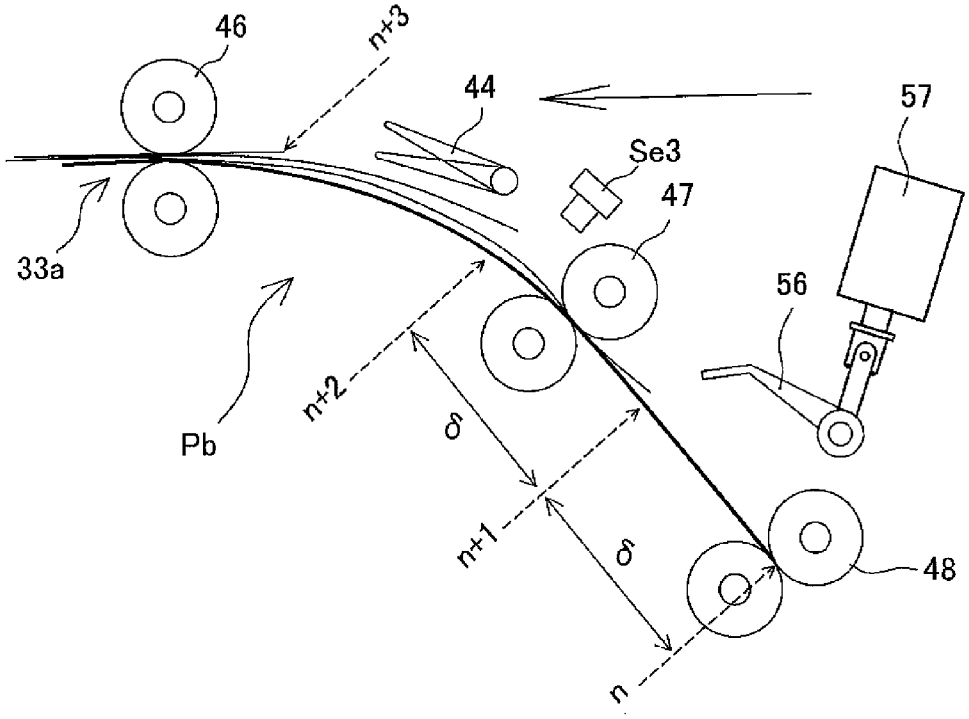
Figure 9B:
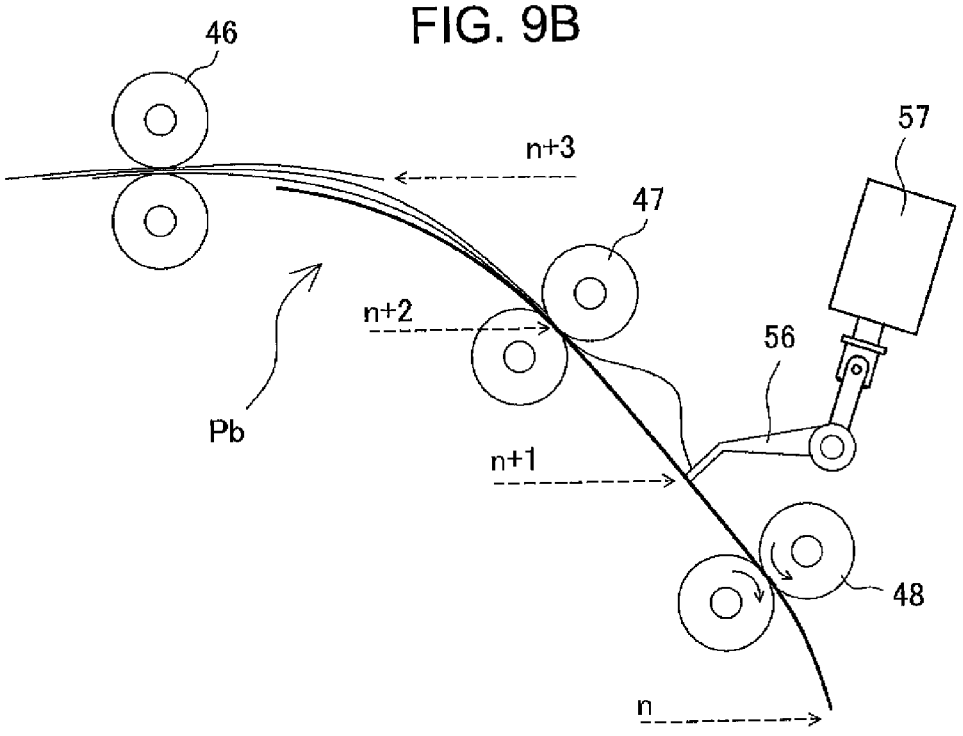
Figure 10:
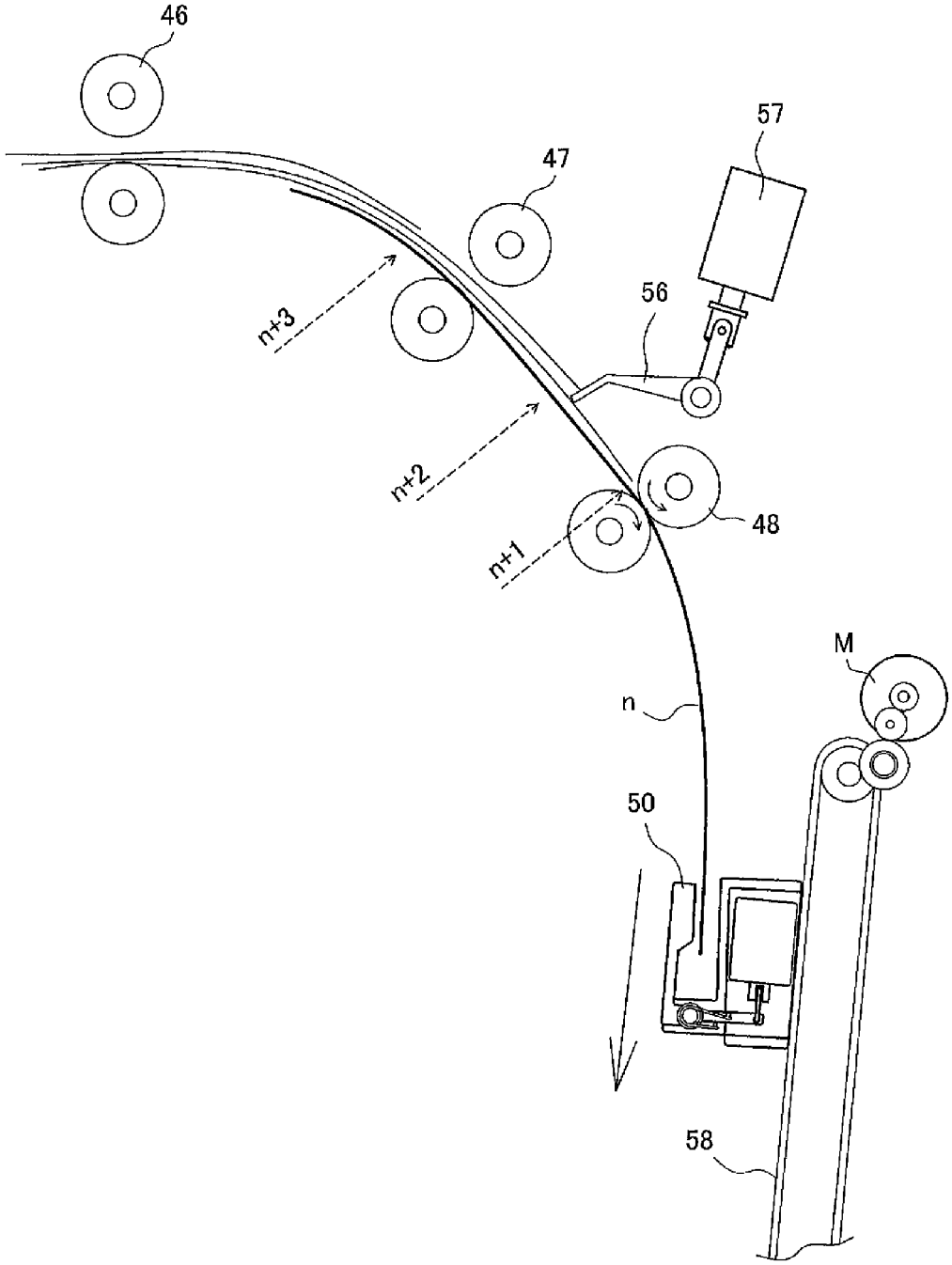
FIG. 10 is an explanatory view illustrating an operation state where the buffer sheets are conveyed to the second post-processing section, in which a first sheet is being carried in the second post-processing section from the buffer section.

The following describes a buffer sheet conveying state in the second post-processing mode with reference to FIGS. 9A and 9B and FIG. 10. FIG. 9A illustrates a state where a plurality of sheets are conveyed to the buffer section Pb and made to temporarily stand by. The sheets fed to the buffer section Pb from the carry-in port 31 are retained by the first and second sheet discharge rollers 46 and 47 in a state of being overlapped in the order of the first sheet (n), second sheet (n+1), and third sheet (n+2) from below. More specifically, the plurality of sheets are overlapped in a scale shape with the offset amount δ in the feeding order (in the order that they are fed to the carry-in port 31). The offset amount δ in this case may be the same as or different from the offset amount δ set in the first post-processing mode.

When a state is reached in which the sheets can be carried in the second post-processing section 49 (when the post-processing operation in the second post-processing section is completed), the controller 76 conveys one by one the sheets made to stay in the buffer section Pb from the second sheet discharge port 33*a* to the accumulation guide 49*a* in the order that they are fed to the carry-in port 31. Specifically, the controller 76 rotates the second and third sheet discharge rollers 47 and 48 in the sheet conveying direction. At this time, the first sheet discharge roller 46 is rotated in the same direction or separated from the sheets.

Subsequently, the controller 76 puts each of the first and second sheet discharge rollers 46 and 47 in a state of being separated from the sheets (in a standby posture). Then, as illustrated in FIG. 10, the sheet is nipped by the third sheet discharge roller 48 and fed to the accumulation guide 49*a* by rotation thereof. At this time, the stopper 56 is activated so as to prevent the overlapped upper sheets (n+1, n+2) from being drawn downstream (in the direction toward the accumulation guide 49*a*).

In this manner, the plurality of sheets made to stay in the buffer section Pb are fed to the accumulation guide 49*a* in the order that they are stacked (in the order of n (sheet that has first been made to stay), n+1, and n+2).

Figure 6A:
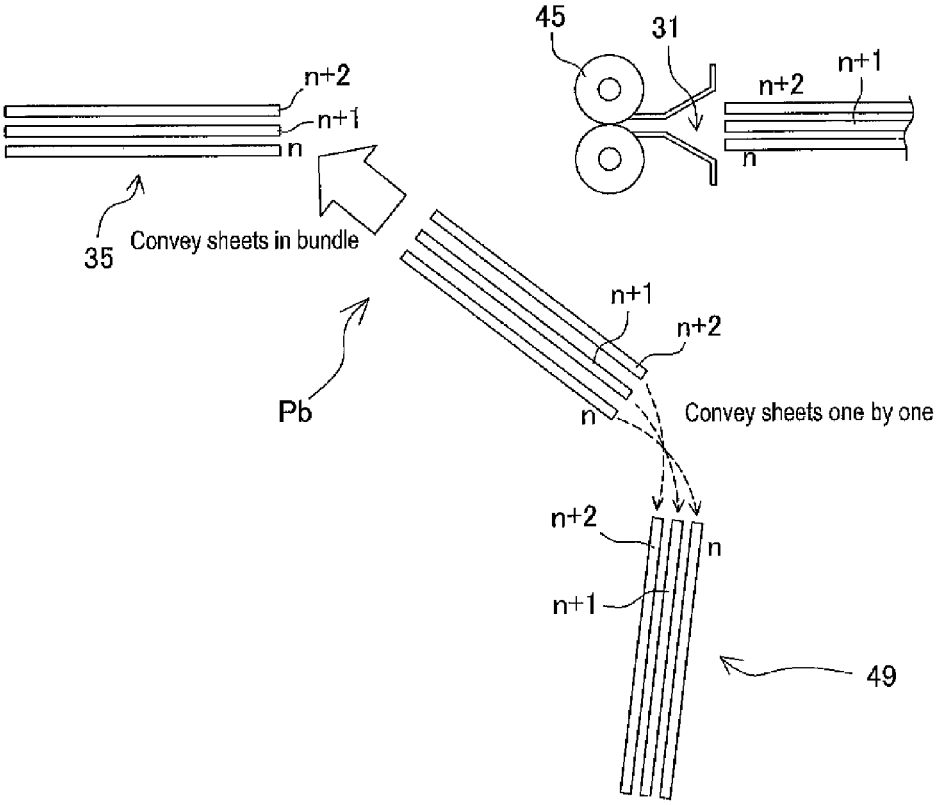
FIG. 6A is an explanatory view illustrating a state where sheets made to stay in a path buffer section are conveyed to the post-processing section.
Figure 6B:
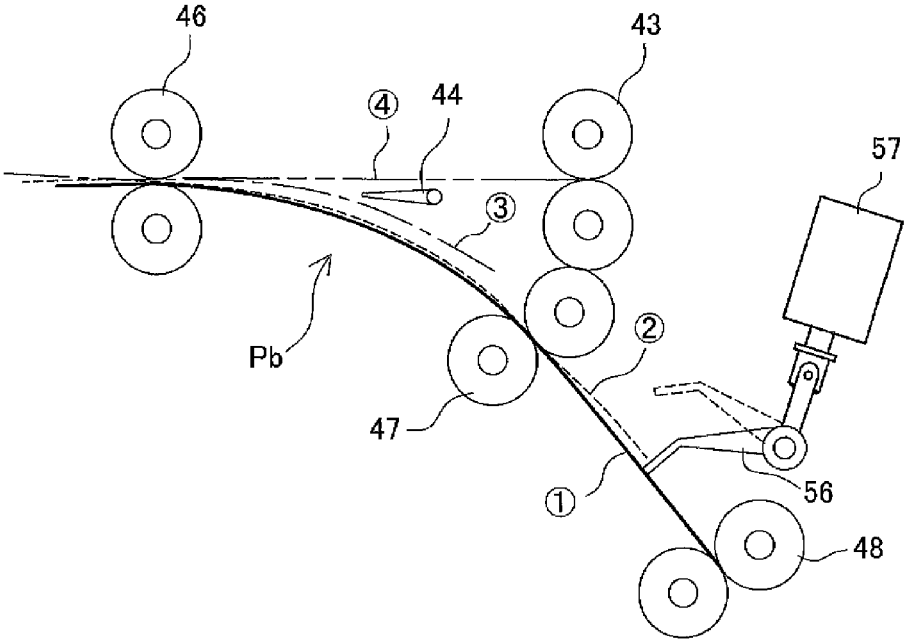
FIG. 6B is an explanatory view illustrating a mechanism that conveys buffer sheets to the second post-processing section.

The following describes a conveying mechanism of the branch path 34 illustrated in FIG. 6B. As described above, along the branch path 34, the second and third sheet discharge rollers 47 and 48 are disposed separated from each other so as to feed the sheet from the second sheet discharge port 34*a* to second post-processing section (accumulation guide 49*a*). A separating unit that prevents sheet overlap feeding is disposed between the second and third sheet discharge rollers 47 and 48. When one (lowermost one) of the overlapped sheets is carried out, the separating unit prevents the sheets stacked on the lowermost sheet from being drawn downstream (in the direction toward the accumulation guide 49*a*).

The separating unit illustrated in FIG. 6B includes a braking lever 56 having a locking portion and an operating solenoid 57 that swings the braking lever 56 between a standby position and an operating position. When the lower sheet (e.g., the first buffer sheet) is conveyed from the second sheet discharge port 34*a* to accumulation guide 49*a*, the separating unit locks the upper sheet (second buffer sheet) to prevent it from being drawn downstream (in the direction toward the accumulation guide 49*a*).

Figure 11:
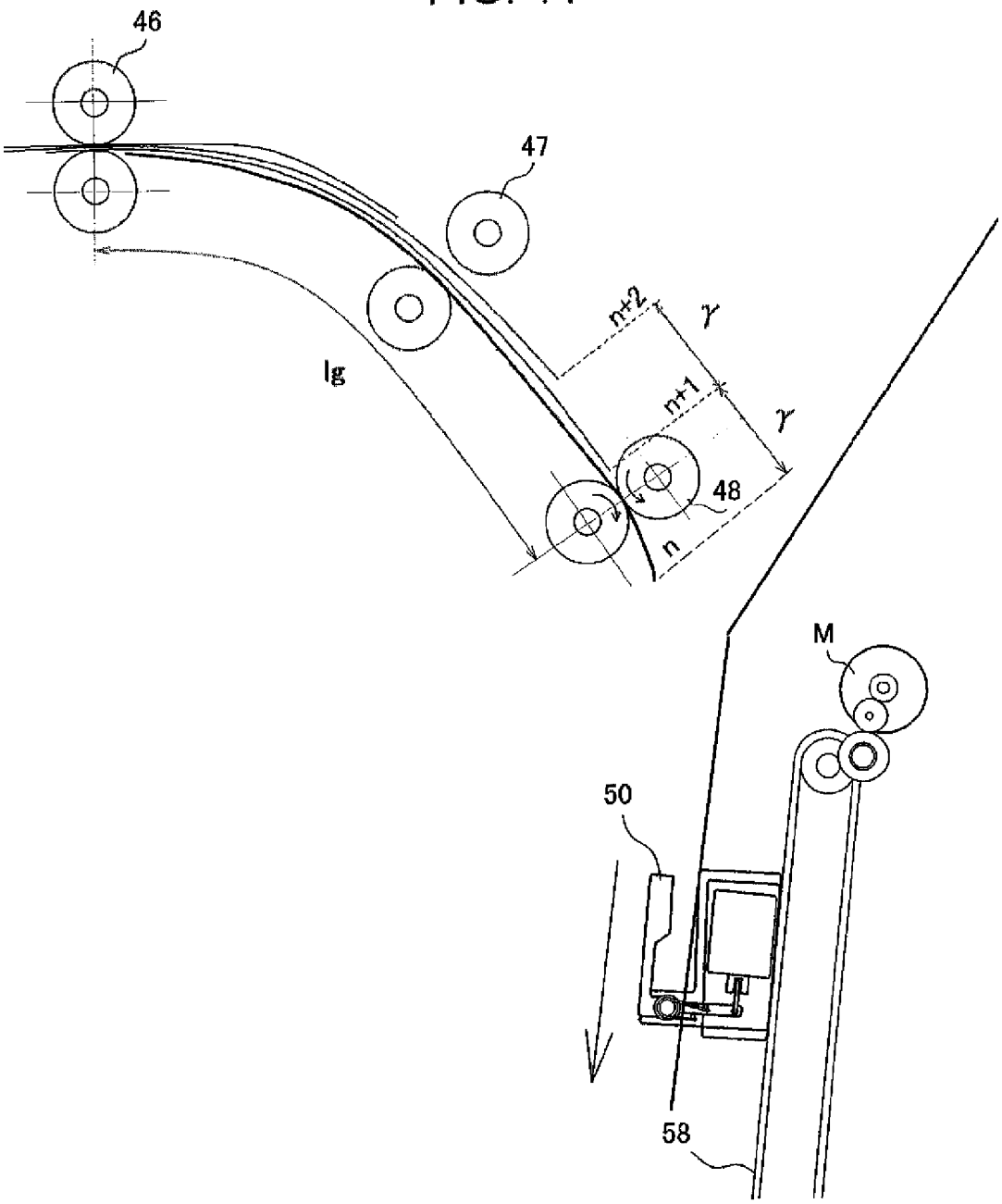
FIG. 11 is an explanatory view of a state where the buffer sheets are conveyed to the second processing section, which illustrates a state different from that in FIG. 10 where the first sheet is carried in the second post-processing section from the buffer section.

The following describes another example of the conveying state of the buffer sheets in the second post-processing mode with reference to FIG. 11. FIG. 11 illustrates a state where a plurality of sheets are conveyed to the buffer section Pb and made to temporarily stay therein. The sheets fed to the buffer section Pb from the carry-in port 31 are retained by the first and second sheet discharge rollers 46 and 47 in a state of being overlapped in the order of the first sheet (n), the second sheet (n+1), and the third sheet (n+2) from below. More specifically, the plurality of sheets are overlapped in a scale shape with the offset amount $\gamma$ in the feeding order (in the order that they are fed to the carry-in port 31). The offset amount $\gamma$ is set larger than a difference between a length (lp) of a sheet to be conveyed and a length (lg) between the first and third sheet discharge rollers 46 and 48 ($lp-lg<\gamma$).

Then, when a state is reached in which the sheets can be carried in the second post-processing section 49 (when the post-processing operation in the second post-processing section is completed), the controller 76 rotates the first to third sheet discharge rollers 46 to 48 in the sheet conveying direction so as to convey one by one the sheets made to stay in the buffer section Pb from the second sheet discharge port 33*a* to the accumulation guide 49*a* in the order that they are fed to the carry-in port 31.

Then, the controller 76 separates the second sheet discharge roller 47 from the sheets and stops or decelerates the first conveying roller 46 during a time from when a leading end of the first sheet (n) passes through the third sheet discharge roller 48 and a rear end thereof passes through the first conveying roller 46 until a rear end of the second sheet (n+1) passes through the first conveying roller 46 to thereby allow the third sheet discharge roller 48 to convey only a lower sheet (e.g., the first buffer sheet (n)) from the second sheet discharge port 34*a* to accumulation guide 49*a*. At the same time, the first sheet discharge roller 46 locks the upper sheets (second (n+1) and succeeding buffer sheets) to thereby prevent them to be drawn downstream (in the direction toward the accumulation guide 49*a*). When the rear end of the first sheet (n) passes through the second sheet discharge roller 47, the controller 76 sets back the second sheet discharge roller 47 to a press-contact position to thereby allow the sheet staying in the buffer section Pb to be conveyed to the third sheet discharge roller 48 by the first and second sheet discharge rollers 46 and 47. The above operation is repeatedly performed to thereby carry the sheets made to stay in the buffer section Pb one by one into the accumulation guide 49*a*.

FIG. 12 illustrates a state where a succeeding sheet is fed to the carry-in port 31 from the image forming device A during conveyance of the sheets (n, n+1, n+2, . . . ) made to stay in the buffer section Pb to the second post-processing section 49. In this state, the buffer sheet is fed in a direction of an arrow A from the first sheet discharge roller 46, while the succeeding sheet fed from the carry-in port 31 is fed in a direction of an arrow B. That is, the buffer sheet and the succeeding sheet are moved in opposite directions while passing by each other at vertically overlapping positions.

Then, the controller 76 rotates the third sheet discharge roller 48 in a direction of an arrow in FIG. 12 (second sheet discharge roller 47 is rotated in the same direction or stopped/separated). Then, the sheet staying in the buffer section Pb is fed from the second sheet discharge port 34*a* to the second processing section 49. At this time, the controller 76 separates the pair of first sheet discharge rollers 46 from each other. This prevents the succeeding sheet to be made to pass through the first sheet discharge roller 46 in the opposite direction from being impeded.

Although a configuration of the roller pair is not illustrated especially, one of the pair of rollers is axially supported so as to be movable between a press-contact direction and a separating direction and biased by means of a biasing spring in the press-contact direction. Further, a release lever that shifts the movable side roller in the separating direction against the biasing force of the spring is provided and is moved by a drive unit such as an operating solenoid or an operating cam.

What is claimed is:

1. A processing device, comprising:

first and second different accumulating sections;

a conveying path along which a sheet is fed from a carry-in port to the first accumulating section;

a branch path branched from the conveying path at a branch portion, along which the sheet is fed to the second accumulating section;

a first conveying roller disposed in the conveying path at a position downstream of the branch portion;

a second conveying roller disposed in the branch path at a position downstream of the branch portion; and a controller that controls the first and second conveying rollers, wherein a buffer path section for a sheet to temporarily stay at a portion between the first and second conveying rollers is disposed in the conveying path and the branch path, the controller makes a plurality of sheets sequentially fed to the carry-in port temporarily stay in the buffer path section and selectively conveys the plurality of sheets to the first accumulating section by rotating the first and second conveying rollers in one direction and to the second accumulating section by rotating the first and second conveying rollers in an opposite direction to the one direction, the first conveying roller is constituted by a pair or rollers separable from each other or capable of reducing press-contact force therebetween, and the controller reduces the press-contact force between the roller pair or separates the roller pair from each other when conveying the sheet made to stay in the buffer path section in the same direction as that in which the sheet is fed from the carry-in port.

2. The processing device according to claim 1, wherein the buffer path section is an area where the sheet is made to stay between the first and second conveying rollers.

3. The processing device according to claim 1, wherein the branch path is disposed such that the sheet fed from the conveying path while reversing a conveying direction is directed toward the second accumulating section.

4. The processing device according to claim 1, wherein when conveying the sheet made to stay in the buffer path section to the first accumulating section, the controller conveys the sheet simultaneously with a succeeding sheet fed to the carry-in port in a direction same as the conveying direction of the succeeding sheet, and when conveying the sheet made to stay in the buffer path section to the second accumulating section, the controller conveys the sheet simultaneously with the succeeding sheet in a direction opposite to the conveying direction of the succeeding sheet.

5. An image forming system comprising:

an image forming device that forms an image on a sheet; and a processing device that accumulates and performs post-processing for the sheet fed from the image forming device, wherein the processing device is the device as claimed in claim 1.

6. A processing device, comprising:

first and second different accumulating sections;

a conveying path along which a sheet is fed from a carry-in port to the first accumulating section;

a branch path branched from the conveying path at a branch portion, along which the sheet is fed to the second accumulating section;

a first conveying roller disposed in the conveying path at a position downstream of the branch portion;

a second conveying roller disposed in the branch path at a position downstream of the branch portion; and a controller that controls the first and second conveying rollers, wherein a buffer path section for a sheet to temporarily stay at a portion between the first and second conveying rollers is disposed in the conveying path and the branch path, the controller makes a plurality of sheets sequentially fed to the carry-in port temporarily stay in the buffer path section and selectively conveys the plurality of sheets to the first accumulating section by rotating the first and second conveying rollers in one direction and to the second accumulating section by rotating the first and second conveying rollers in an opposite direction to the one direction, when conveying the sheet made to stay in the buffer path section to the first accumulating section, the controller brings the second conveying roller into press-contact, and when conveying the sheet made to stay in the buffer path section to the second accumulating section, the controller reduces press-contact force at the second conveying roller or separates the second conveying roller.

7. The processing device according to claim 6, wherein the buffer path section is an area where the sheet is made to stay between the first and second conveying rollers.

8. The processing device according to claim 6, wherein the branch path is disposed such that the sheet fed from the conveying path while reversing a conveying direction is directed toward the second accumulating section.

9. The processing device according to claim 6, wherein when conveying the sheet made to stay in the buffer path section to the first accumulating section, the controller conveys the sheet simultaneously with a succeeding sheet fed to the carry-in port in a direction same as the conveying direction of the succeeding sheet, and when conveying the sheet made to stay in the buffer path section to the second accumulating section, the controller conveys the sheet simultaneously with the succeeding sheet in a direction opposite to the conveying direction of the succeeding sheet.

10. An image forming system comprising:

an image forming device that forms an image on a sheet; and a processing device that accumulates and performs post-processing for the sheet fed from the image forming device, wherein the processing device is the device as claimed in claim 6.

11. A processing device, comprising:

first and second different accumulating sections;

a conveying path along which a sheet is fed from a carry-in port to the first accumulating section;

a branch path branched from the conveying path at a branch portion, along which the sheet is fed to the second accumulating section;

a first conveying roller disposed in the conveying path at a position downstream of the branch portion;

a second conveying roller disposed in the branch path at a position downstream of the branch portion; and a controller that controls the first and second conveying rollers, wherein a buffer path section for a sheet to temporarily stay at a portion between the first and second conveying rollers is disposed in the conveying path and the branch path, the controller makes a plurality of sheets sequentially fed to the carry-in port temporarily stay in the buffer path section and selectively conveys the plurality of sheets to the first accumulating section by rotating the first and second conveying rollers in one direction and to the second accumulating section by rotating the first and second conveying rollers in an opposite direction to the one direction, when conveying the sheet made to stay in the buffer path section to the first accumulating section, the controller brings the first conveying roller into press-contact, and when conveying the sheet made to stay in the buffer path section to the second accumulating section, the controller reduces press-contact force at the first conveying roller or separates the first conveying roller.

12. The processing device according to claim 11, wherein when conveying the plurality of sheets made to stay in the buffer path section to the first accumulating section, the controller conveys the sheets in a bundle, and when conveying the plurality of sheets made to stay in the buffer path section to the second accumulating section, the controller conveys the sheets one by one in the order that they are made to stay in the buffer path section.

13. The processing device according to claim 11, wherein the buffer path section is an area where the sheet is made to stay between the first and second conveying rollers.

14. The processing device according to claim 11, wherein the branch path is disposed such that the sheet fed from the conveying path while reversing a conveying direction is directed toward the second accumulating section.

15. An image forming system comprising:

an image forming device that forms an image on a sheet; and a processing device that accumulates and performs post-processing for the sheet fed from the image forming device, wherein the processing device is the device as claimed in claim 11.

16. A processing device, comprising:

first and second different accumulating sections;

a conveying path along which a sheet is fed from a carry-in port to the first accumulating section;

a branch path branched from the conveying path at a branch portion, along which the sheet is fed to the second accumulating section;

a first conveying roller disposed in the conveying path at a position downstream of the branch portion;

a second conveying roller disposed in the branch path at a position downstream of the branch portion; and a controller that controls the first and second conveying rollers, wherein a buffer path section for a sheet to temporarily stay at a portion between the first and second conveying rollers is disposed in the conveying path and the branch path, the controller makes a plurality of sheets sequentially fed to the carry-in port temporarily stay in the buffer path section and selectively conveys the plurality of sheets to the first accumulating section by rotating the first and second conveying rollers in one direction and to the second accumulating section by rotating the first and second conveying rollers in an opposite direction to the one direction, a sheet discharge roller is disposed in the branch path at a position downstream of the second conveying roller, and when conveying the plurality of sheets made to stay in the buffer path section to the second accumulating section, the controller rotates the sheet discharge roller while reducing press-contact force of the second conveying roller or separating the second conveying roller.

17. The processing device according to claim 16, wherein the buffer path section is an area where the sheet is made to stay between the first and second conveying rollers.

18. The processing device according to claim 16, wherein the branch path is disposed such that the sheet fed from the conveying path while reversing a conveying direction is directed toward the second accumulating section.

19. The processing device according to claim 16, wherein when conveying the plurality of sheets made to stay in the buffer path section to the first accumulating section, the controller conveys the sheets in a bundle, and when conveying the plurality of sheets made to stay in the buffer path section to the second accumulating section, the controller conveys the sheets one by one in the order that they are made to stay in the buffer path section.

20. An image forming system comprising:

an image forming device that forms an image on a sheet; and a processing device that accumulates and performs post-processing for the sheet fed from the image forming device, wherein the processing device is the device as claimed in claim 16.

* * * * *